US006035819A

United States Patent [19]

Nakayoshi et al.

[11] Patent Number: 6,035,819

[45] Date of Patent: Mar. 14, 2000

[54] VARIABLE VALVE TIMING CONTROLLER

[75] Inventors: Hideki Nakayoshi; Katsuhiko Eguchi, both of Kariya; Kongo Aoki, Toyota, all of Japan

[73] Assignee: Aisin Seiki Kabushiki Kaisha, Aichi-pref., Japan

[21] Appl. No.: 09/239,722

[22] Filed: Jan. 29, 1999

[51] Int. Cl.[7] ..... F01L 1/344

[52] U.S. Cl. ..... 123/90.17; 123/90.31

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 4,858,572 | 8/1989 | Shirai et al. | 123/90.12 |
| 5,775,279 | 7/1998 | Ogawa et al. | 123/90.17 |
| 5,870,983 | 2/1999 | Sato et al. | 123/90.17 |

FOREIGN PATENT DOCUMENTS

| | | |
|---|---|---|
| 1-92504 | 4/1989 | Japan . |
| 9-060507 | 3/1997 | Japan . |
| 9-250310 | 9/1997 | Japan . |
| 9-280017 | 10/1997 | Japan . |

*Primary Examiner*—Weilun Lo

*Attorney, Agent, or Firm*—Reed Smith Hazel & Thomas LLP

[57] ABSTRACT

A variable valve timing controller according to the present invention comprises a locking mechanism for holding the vane in the middle of the pressure chamber until the internal combustion engine starts; and a damper for sealing up one of the advance chamber and the delay chamber and for slowing the relative rotation between the rotational shaft and the rotation-transmitting member. According to the present invention, the locking mechanism maintains the vane in the middle of the pressure chamber until the internal combustion engine starts. Therefore, the vane cannot vibrate even when unstable transitional pressure is supplied to the pressure chamber so that no undesirable noise shall be generated. Further, the valve timing may be further delayed after the internal combustion engine starts since the vane is maintained in the middle of the pressure chamber. Therefore, the valve timing may be consistently optimized not only for easy engine starting but also for the high-speed operation of the internal combustion engine. Thus, the volumetric efficiency can be improved by the inertia of the air intake under high-speed operation of the internal combustion engine.

20 Claims, 14 Drawing Sheets

VARIABLE VALVE TIMING CONTROLLER

BACKGROUND OF THE INVENTION

This invention relates to a variable valve timing controller to control the valve timing of an internal combustion engine.

A conventional variable valve timing controller comprises: a rotational shaft for opening and closing a valve; a rotation transmitting member rotatably mounted on the rotational shaft; a vane supported by the rotational shaft; a pressure chamber formed between the rotational shaft and the rotation transmitting member and divided into an advance chamber and a delay chamber by the vane; an advance fluid passage communicated with the advance chamber for supplying and discharging an operational fluid; a delay fluid passage communicated with the delay chamber for supplying and discharging the operational fluid; and a locking mechanism for maintaining a relative position between the rotational shaft and the rotation transmitting member. Such a conventional variable timing device is disclosed, for example, in Japanese Patent Laid-Open Publication No. 01-92504 published in Japan on Apr. 11, 1989 (corresponding to U.S. Pat. No. 4,858,572 issued in the United States on Aug. 22, 1989, the entire disclosure of which is incorporated herein by reference) and in Japanese Patent Laid-Open Publication No. 09-250310 published in Japan on Sep. 22, 1997.

In the conventional variable valve timing controller, the valve timing is advanced due to relative rotation between the rotational shaft and the rotation transmitting member when the operational fluid is supplied to the advance chamber and is discharged from the delay chamber. On the contrary, the valve timing is delayed due to the opposite rotation between the rotational shaft and the rotation transmitting member when the operational fluid is discharged from the advance chamber and is supplied to the delay chamber.

Further, in the conventional variable valve timing controller disclosed in the above-mentioned publications, the vane transmits torque from the rotation-transmitting member to the rotational shaft. Therefore, the rotational shaft always receives a counter torque to expand the delay chamber while the internal combustion engine runs. When the internal combustion engine stalls, due to the counter torque, the rotational shaft rotates to expand the delay chamber since pressure of the operational fluid is insufficient to hold the vane at the current position. Thus, the rotational shaft reaches the most delayed position where the delay chamber is the most expanded. In case the internal combustion engine is restarted at the most delayed position of the rotational shaft, due to unstable transitional pressure, the vane vibrates and generates undesirable noise. Conventionally, the locking mechanism maintains the predetermined relative position between the rotational shaft and the rotation-transmitting member so that generation of vibration of the vane is somewhat prevented.

By the way, air intake tries to flow into a cylinder of the internal combustion engine by inertia even after the piston begins to go to the top dead center while the internal combustion engine runs at high speed. Therefore, volumetric efficiency may be improved by delayed closure of an air-intake valve so that the output of the internal combustion engine may be improved.

However, in the conventional variable valve timing controller, the most delayed timing has to be set so that the air intake is sufficient to start the internal combustion engine. This means that the closing timing of the air-intake valve is not optimized for the high-speed operation of the internal combustion engine. Thus, the volumetric efficiency cannot be improved by the inertia of the air intake. If the closing timing of the air intake valve is unreasonably optimized for the high-speed operation of the internal combustion engine, the air intake which is once inhaled into the cylinder flows backward upon start of the internal combustion engine since the air intake does not have enough inertia and the air-intake valve continues to be opened even after the piston passes the bottom dead center and begins to go to the top dead center. Therefore, the internal combustion engine becomes hard to start due to insufficient compression ratio and imperfect combustion. Further, in the conventional variable valve timing controller, due to low atmospheric pressure, a similar disadvantage may be expected at altitudes if the air intake valve is set to be closed at around the bottom dead center of the piston.

Further, in the conventional variable timing controller, if the exhaust valve timing is delayed similarly, an amount of exhaust gas recirculation is increased by an extended overlapping time of the air-intake valve and the exhaust valve so that the internal combustion engine becomes hard to start.

SUMMARY OF THE INVENTION

Accordingly, a feature of the present invention is to solve the above conventional drawbacks.

Further, a feature of the present invention is to reduce vibration of a vane upon start of the internal combustion engine.

Furthermore, a feature of the present invention is to start the internal combustion engine more easily.

Yet further, a feature of the present invention is to expand a variable range for valve timing.

To achieve the above features, a variable valve timing controller according to the present invention comprises: a rotational shaft for opening and closing the valve; a rotation-transmitting member rotatably mounted on the rotational shaft; a pressure chamber formed between the rotational shaft and the rotation-transmitting member; an advance chamber formed in the pressure chamber to advance the valve timing by expansion thereof; a delay chamber formed in the pressure chamber to delay the valve timing by expansion thereof; a vane supported by either one of the rotational shaft or the rotation transmitting member and for dividing the pressure chamber into the advance chamber and the delay chamber; an advance fluid passage communicated with the advance chamber for supplying and discharging the operational fluid; a delay fluid passage communicated with the delay chamber for supplying and discharging the operational fluid; a locking mechanism for holding the vane in the middle of the pressure chamber until the internal combustion engine starts; and a damper for sealing up one of the advance chamber and the delay chamber and for slowing the relative rotation between the rotational shaft and the rotation-transmitting member.

According to the present invention, the locking mechanism maintains the vane in the middle of the pressure chamber until the internal combustion engine starts. Therefore, the vane cannot vibrate even when unstable transitional pressure is supplied to the pressure chamber so that undesirable noise shall not be generated at all.

Further, the valve timing may be further delayed after start of the internal combustion engine since the vane is maintained in the middle of the pressure chamber. Therefore, the valve timing may be consistently optimized not only for an easy engine start but also for the high-speed operation of the internal combustion engine. Thus, the volumetric efficiency can be improved by the inertia of the air intake under high-speed operation of the internal combustion engine.

BRIEF DESCRIPTION OF THE DRAWINGS

The foregoing and additional features of the present invention will become more apparent from the following detailed description of an embodiment thereof when considered with reference to the attached drawings, in which.

DETAILED DESCRIPTION OF THE PREFERRED EMBODIMENTS

Figure 1:
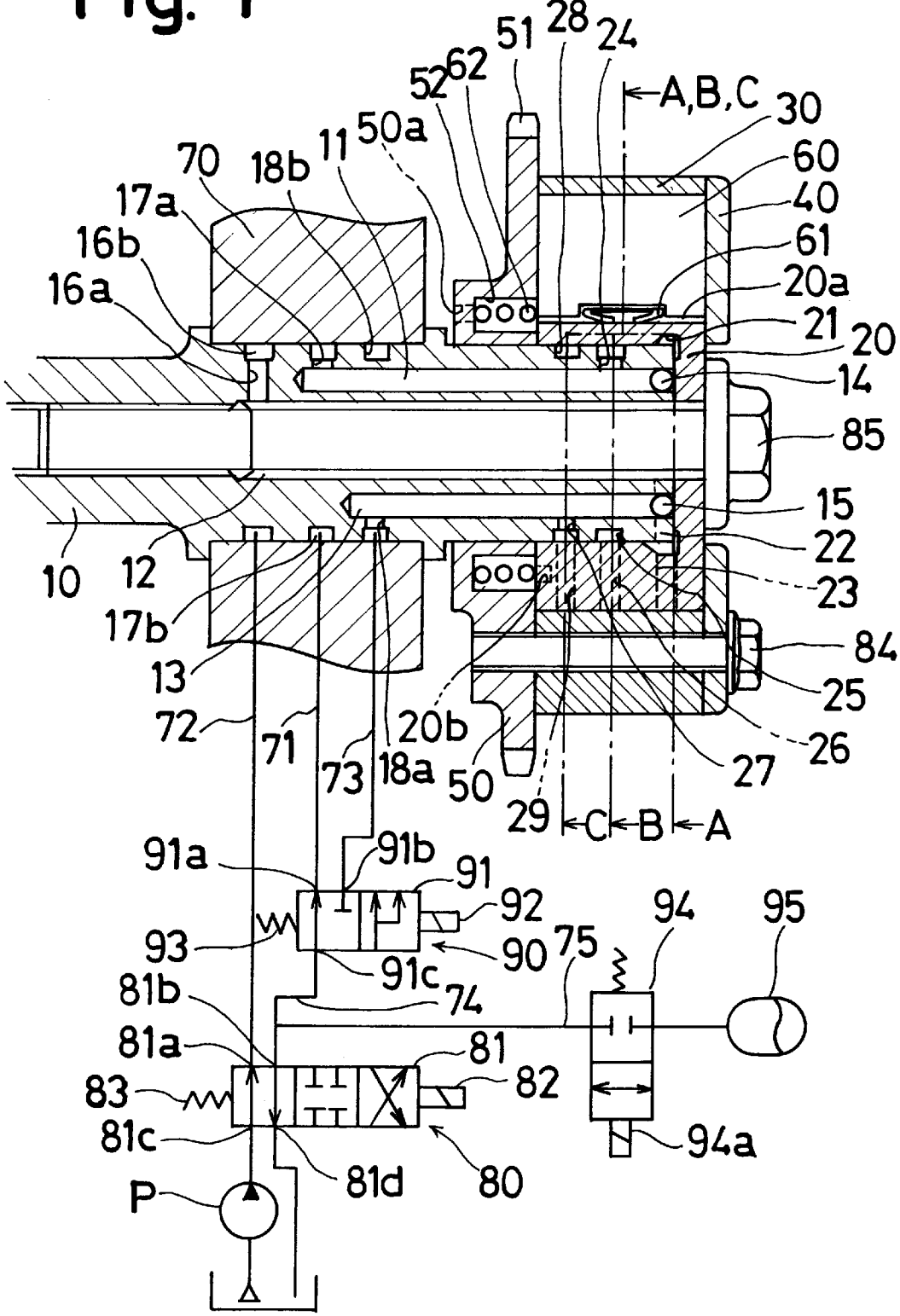
FIG. 1 is a cross sectional view of a variable valve-timing controller according to the first embodiment of the present invention.

Referring now to attached drawings, preferred embodiments of the present invention are explained.

FIGS. 1 through 7 show the first embodiment of the present invention. As shown in FIGS. 1 through 5, a variable timing valve controller comprises a camshaft 10, an internal rotor 20, an external rotor 30, a front plate 40, a rear plate 50, a timing sprocket 51, four vanes 60 and a lock mechanism 100. The camshaft 10 is rotatably supported by a cylinder head 70 of an internal combustion engine (not shown). The internal rotor 20 is integrally fixed to an end (a right end in FIG. 1) of the camshaft 10. The camshaft 10 and the internal rotor 20 constitute a rotational shaft to drive an air-intake valve and an exhaust valve of the internal combustion engine. The external rotor 30 is rotatably supported by both the camshaft 10 and the internal rotor 20. The external rotor 30 can rotate within a predetermined angle relative to the camshaft 10 and the internal rotor 20. The timing sprocket 51 is integrally formed on the outer circumference of the rear plate 50. The external rotor 30, the front plate 40, the rear plate 50 and the timing sprocket 51 constitute a rotation-transmitting member. The internal rotor 20 supports four vanes 60. The lock mechanism 100 is provided in the external rotor 20. The timing sprocket 51 is linked to a crankshaft (not shown) of the internal combustion engine through a timing chain (not shown). The timing sprocket 51 is driven by the crankshaft so that the rotation-transmitting member is rotated clockwise in FIG. 2.

Figure 2:
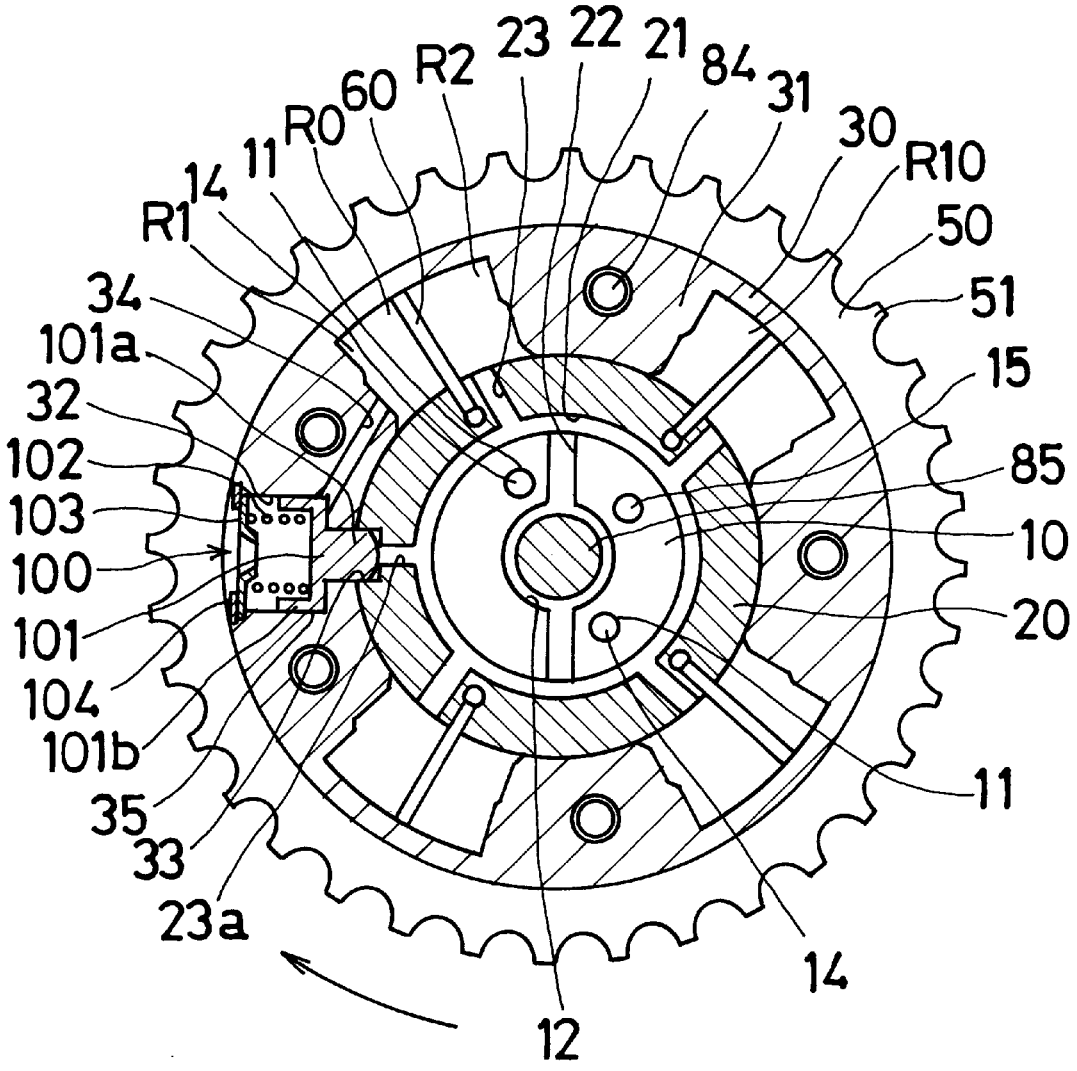
FIGS. 2 and 3 are cross sectional views of the variable timing controller taken along line A—A in FIG. 1.

The camshaft 10 has cams (not shown) in order to lift the air-intake and exhaust valves. The interior of the camshaft 10 includes first advance fluid passages 11, a second advance fluid passage 13 and a delay fluid passage 12. As shown in FIG. 2, two of the first advance fluid passages 11 are formed in the camshaft 10. Both of the first advance fluid passages 11 are connected to a connection port 91*a* of the switching valve 90 through a radial passage 17*a*, a ring groove 17*b* and a communication passage 71. The radial passage 17*a* and the ring groove 17*b* are formed on the camshaft 10. The communication passage 71 is formed in the cylinder head 70. The delay passage 12 is formed by a gap between a screw 82 and an axial hole meshed with the screw 82. The delay passage 12 communicates with a connection port 81*a* of a control valve 80 through a radial passage 16*a*, a ring groove 16*b* and a communication passage 72. The radial passage 16*a* and the ring groove 16*b* are formed on the camshaft 10. The communication passage 72 is formed in the cylinder head 70. Further, the second advance passage 13 is connected to a connection port 91*b* of the switching valve 91 through a radial passage 18*a*, a ring groove 18*b* and a communication passage 73. The radial passage 18*a* and the ring groove 18*b* are formed on the camshaft 10. The communication passage 73 is formed in the cylinder head 70. As shown in FIGS. 1 and 2, balls 14 and 15 are pressed into the first advance passages 11 and the second advance passage 13 in order to close ends of the passages 11 and 13. An oil pump P is driven by the internal combustion engine in order to supply pressurized operational fluid. An outlet port of the oil pump P is connected to the inlet port 81*c*. Further, the connection port 81*b* of the control valve 80 is connected to a connection port 91*c* of the switching valve 90 through a communication passage 74.

The control valve 80 includes a solenoid 82, a spool 81 and a spring 83. In FIG. 1, the solenoid 82 drives the spool 81 leftward against the spring 83 when the solenoid 82 is energized. In the energized state, the control valve 80 connects the inlet port 81*c* to a connection port 81*b* and also connects the connection port 81*a* to a drain port 81*d*. On the contrary, in the normal state, the control valve 80 connects the inlet port 81*c* to the connection port 81*a* and also connects the connection port 81*b* to the drain port 81*d*. The solenoid 82 of the control valve 80 is energized by an electronic controller (not shown). Because of the duty ratio control of the electronic controller, the spool 81 may be linearly controlled to be retained at various intermediate positions. All the ports 81*a*, 81*b*, 81*c* and 81*d* are closed while the spool 81 is retained at the intermediate position.

The switching valve 90 includes a solenoid 92, a spool 91 and a spring 93. In FIG. 1, the solenoid 92 drives the spool 91 leftward against the spring 93 when the solenoid 92 is energized. In the energized state, the switching valve 90 connects the connection port 91*c* to the connection ports 91*a* and 91*b*. On the contrary, in a normal state, the switching valve 90 connects the connection port 91*c* to the connection port 91*a* and closes the connection port 91*b*. Accordingly, in the energized state of the control valve 80, the operational fluid is always supplied to the first advance fluid passages 11 and is selectively supplied to the second advance fluid passage 13 depending on the state of the switching valve 90. Further, in the normal state of the control valve 80, the operational fluid is supplied to the delay fluid passage 12. The solenoid 92 of the switching valve 90 is energized by the electronic controller depending on the running state of the internal combustion engine. It is obvious for the skilled artisan to modify the fluid circuit shown in FIG. 1. For example, the switching valve 90 may be replaced by an open/close valve (not shown). To employ the open/close valve, the communication passage 71 is directly connected to the connection port 81*b* of the control valve 80. Further, the open/close valve interconnects the communication passage 73 and the connection port 81*b*. It is also obvious for the skilled artisan to employ an integrated valve assembly that is equivalent to both the control valve 80 and the switching valve 90.

In the first embodiment, an accumulator 95 is connected to the communication passage 74 through a communication passage 75. An open/close valve 94 is interconnected in the communication passage 75, . Power supply to a solenoid 94*a* is controlled by the electronic controller to conserve a predetermined pressure in the accumulator 95 while the internal combustion engine runs.

Figure 3:
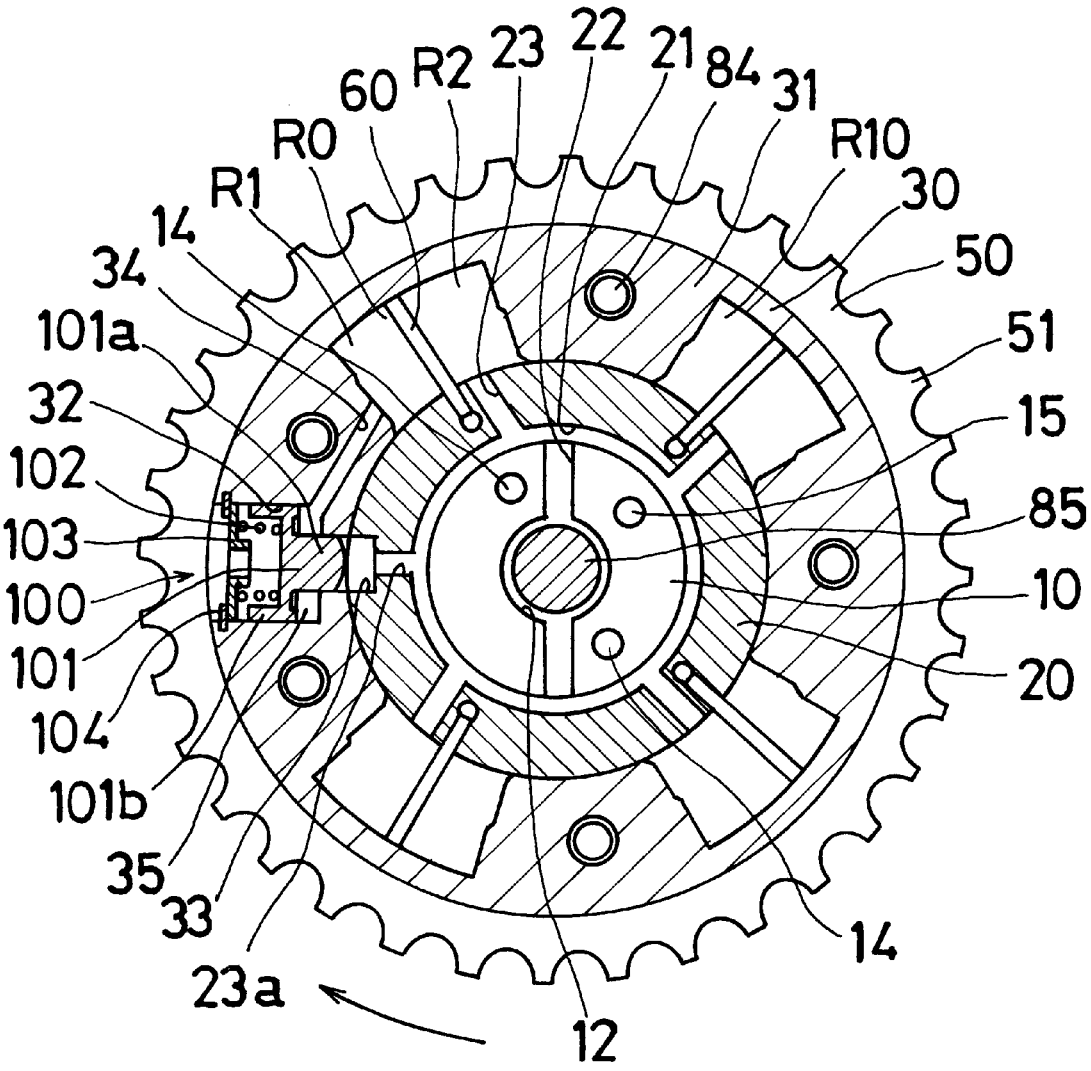
Figure 4:
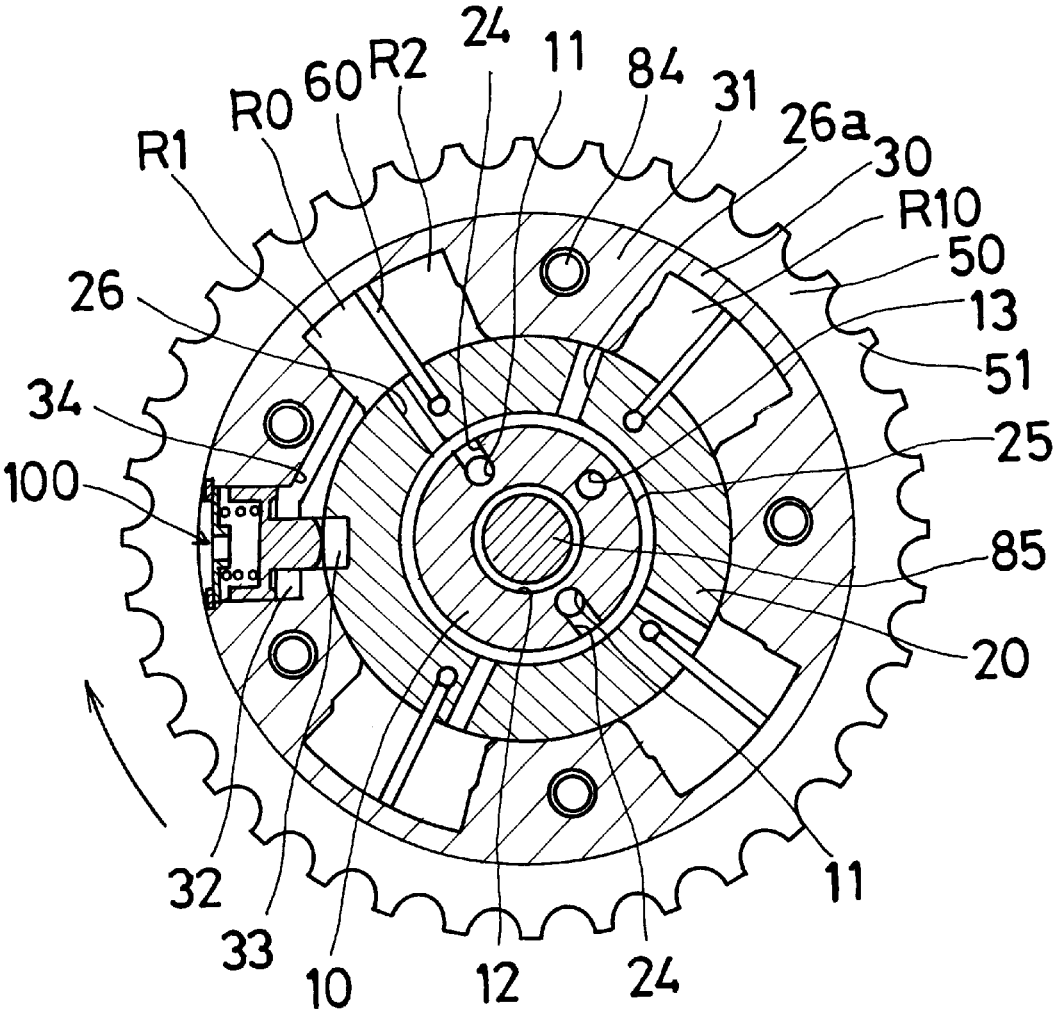
FIG. 4 is a cross sectional view of the variable timing controller taken along line B—B in FIG. 1.
Figure 5:
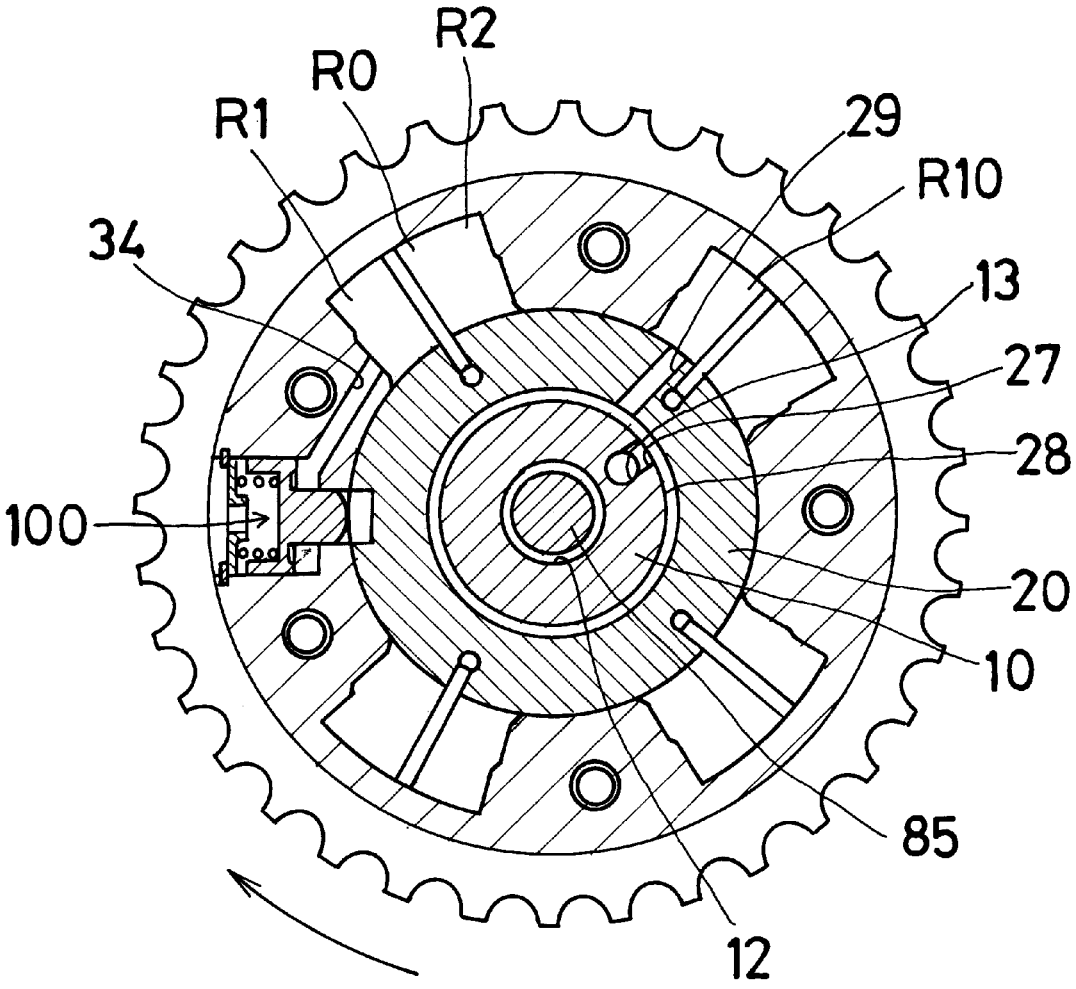
FIG. 5 is a cross sectional view of the variable timing controller taken along line C—C in FIG. 1.

As shown in FIG. 1, the internal rotor 20 is cylindrical and is pressed into the end of the camshaft 10. The internal rotor 20 is fixed to the camshaft 10 by a screw 85 so that a bottom of the internal rotor 20 contacts with the end of the camshaft 10. The internal rotor 20 has four slots 20*a* for supporting the four vanes 60. The vanes 60 may slide in the slots 20*a* in the radial direction of the internal rotor 20. Further, the internal rotor 20 has a receptive bore 33 that receives a small diameter portion 101*a* of a lock pin 101. The lock pin 101 engages with the receptive bore 33 when the external rotor 30 is at an intermediate position relative to the camshaft 10 and the internal rotor 20. Radial passages 22, a ring groove 21 and communication passages 23*a* are provided as shown in FIGS. 1, 2 and 3 in order to supply and discharge the operational fluid between the delay fluid passage 12 and the receptive bore 33. The radial passages 22 are provided at the end of the camshaft 10. Four pressure chambers R0 are formed between the internal rotor 20 and the external rotor 30. Each of the vanes 60 divides each of the pressure chambers R0 into advance chambers R1, R10 and delay chambers R2. In order to supply and discharge the operational fluid to the delay chambers R2, four radial passages 23 are provided in the internal rotor 20 so as to supply and discharge the operational fluid between the delay fluid passage 12 and the delay chamber R2 as shown in FIGS. 2 and 3. Further, as shown in FIG. 4, radial passages 24, a ring groove 25 and communication passages 26, 26*a* are provided in order to supply and discharge the operational fluid to the advance chambers R1 and R10. The radial passages 24 and the ring groove 25 are formed on the camshaft 10. The communication passages 26, 26*a* are formed in the internal rotor 20. Furthermore, as shown in FIG. 5, a radial passage 27, a ring groove 28 and a communication passage 29 are provided in order to supply and discharge the operational fluid to the advance chamber R10. The radial passage 27 and the ring groove 28 are provided in the camshaft 10. The communication passage 29 is provided in the internal rotor 20. The ring grooves 21, 25, 28 are displaced in the axial direction of the camshaft 10 so that no communication is made among the ring grooves 21, 25 and 28. Each of the radial passages 23, 26, 29 is also separately and independently provided in the axial direction of the camshaft 10 so that no communication is made among the radial passages 23, 26 and 29.

The external rotor 30 is cylindrical. At both ends of the external rotor 30, a front plate 40 and a rear plate 50 are attached as shown in FIG. 1. The front plate 40, the external rotor 30 and the rear plate 50 are integrally fastened by five screws 84. Further, four radial projections 31 are formed inwardly in the external rotor 30. Tops of the radial projections 31 are touched with the internal rotor 20 so that the external rotor 30 rotates around the internal rotor 20. The lock pin 101 and a spring 102 are contained in a bore 32 that is formed in one of the radial projections 31. The bore 32 extends in radial direction of the external rotor 30.

Figure 6:
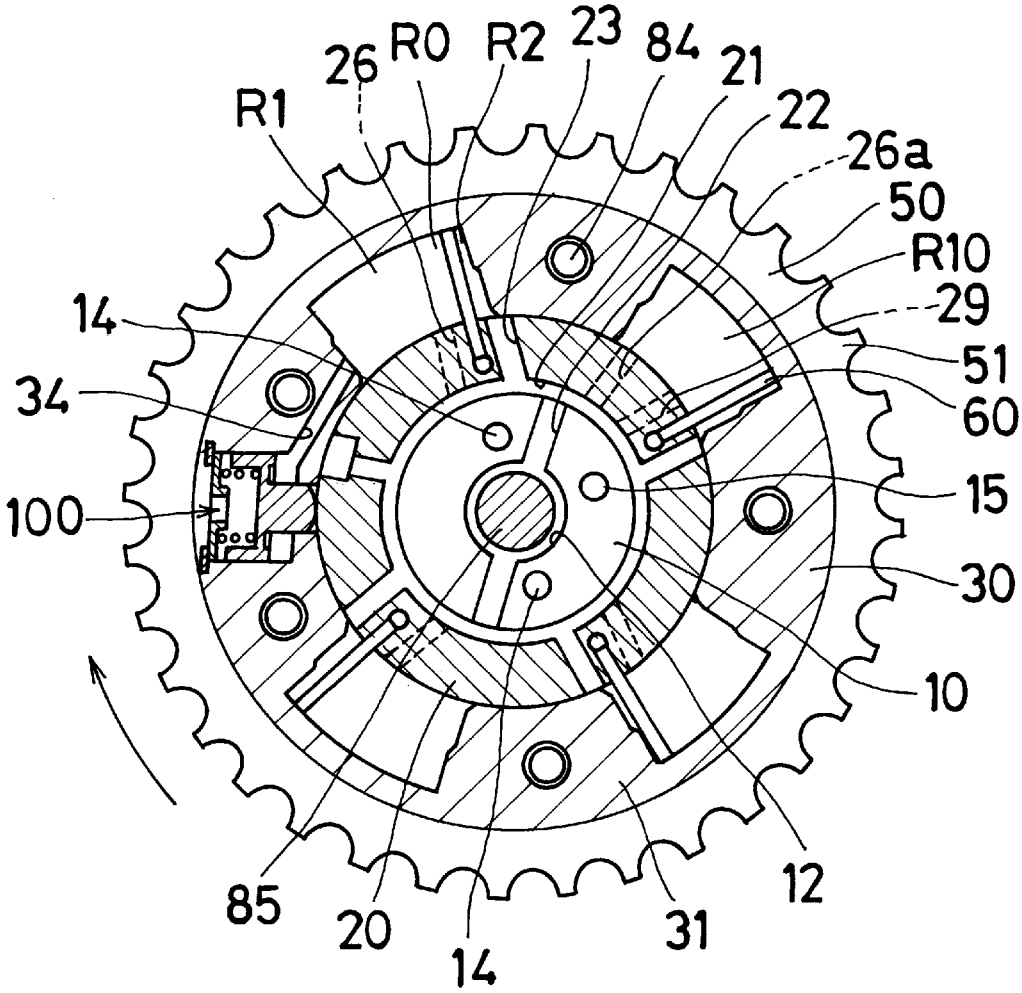
FIG. 6 is a cross sectional view of the variable timing controller showing the most advanced position.
Figure 7:
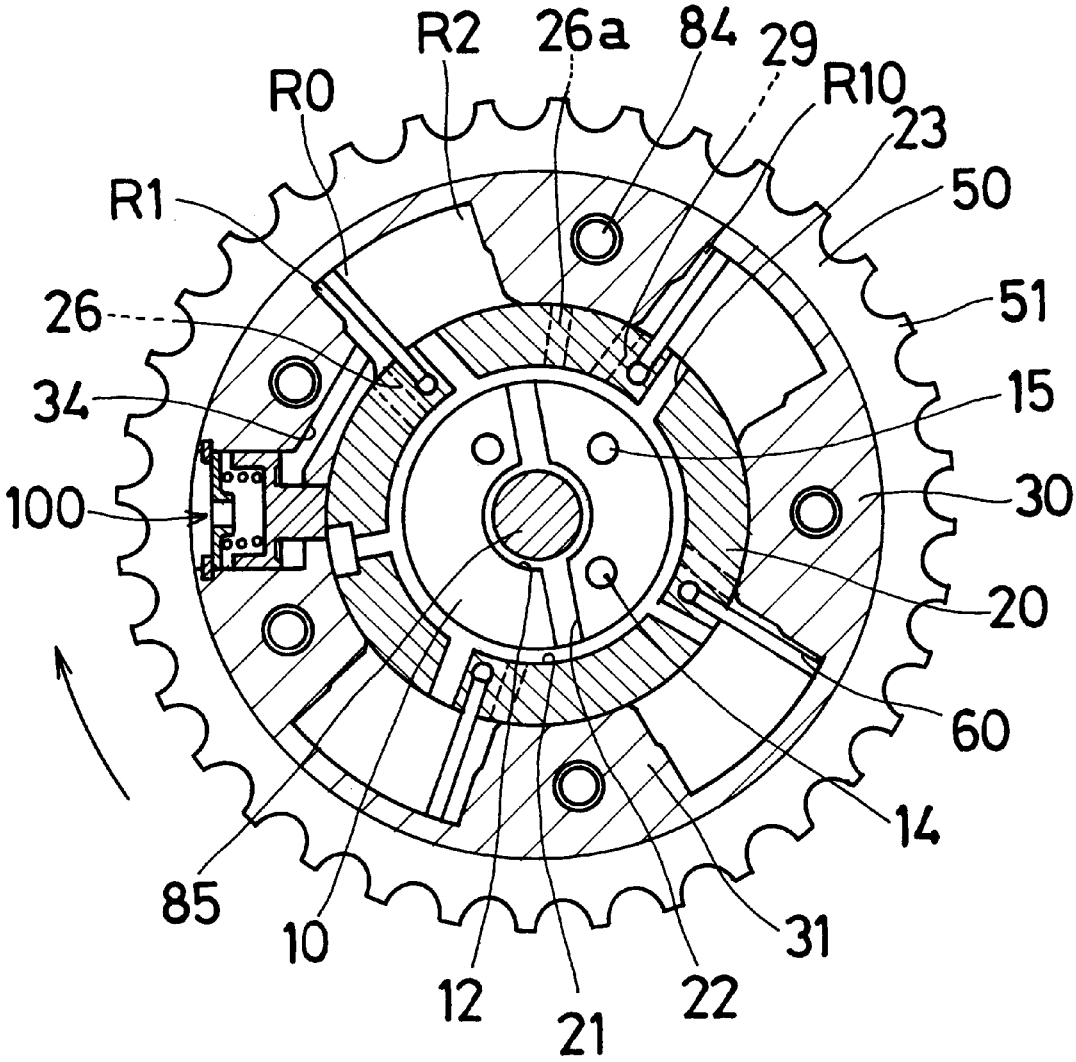
FIG. 7 is a cross sectional view of the variable timing controller showing the most delayed position.

Each vane 60 has a rounded edge that is in contact with the external rotor 30 in a fluid tight manner. Both sides of each vane 60 also touch with both of the plates 40 and 50 in a fluid tight manner. The vanes 60 are capable of sliding in the slots 20*a* in the radial direction of the internal rotor 20. Each vane 60 divides each of the pressure chambers R1 into the advance chamber R1, R10 and the delay chamber R2. The pressure chambers R0 are formed by the external rotor 30, the radial projections 31, the internal rotor 20, the front plate 40 and the rear plate 50. As shown in FIGS. 6 and 7, in order to limit the relative rotation between the internal rotor 20 and the external rotor 30 within a predetermined range, one of the vanes 60 (the lower right) touches with the adjacent radial projections 30 at the most advanced and delayed positions. In other words, as shown in FIG. 6, the most advanced position is achieved when the lower right vane 60 touches with an advance side of the radial projection 31 due to the most expanded advance chambers R1. Further, as shown in FIG. 7, the most delayed position is achieved when the lower right vane 60 touches with a delay side of the radial projection 31 due to the most expanded delay chambers R2.

The lock pin 101 comprises the small diameter portion 101*a* and a large diameter portion 101*b*. The lock pin 101 is slidably inserted in the bore 32. The lock pin 101 is pushed toward the internal rotor 20 by the spring 102. The spring 102 is inserted in the lock pin 101 and a retainer 103. The retainer 103 is held in the bore 32 by a snap ring 104. A ring dent is formed on a step between the small diameter portion 101*a* and the large diameter portion 101*b*. The ring dent forms a ring space 35 when the small diameter portion 101*a* engages with the receptive bore 33 as shown in FIG. 2. The ring space 35 communicates with the adjacent advance chamber R1 through a communication passage 34 formed in the radial projection 31.

A ring groove 52 is formed in the rear plate 50. The ring groove 52 opens toward the internal rotor 20. In the ring groove 52, a torsion coil spring 62 is inserted. One end of the torsion coil spring 62 is hooked in a hole 50*a* drilled in a bottom of the ring groove 52. The other end of the torsion spring 62 is hooked in a hole 20*a* drilled in a base portion of the internal rotor 20. The torsion coil spring 62 biases the internal rotor 20, the vanes 60 and the camshaft 10 toward the most advanced position (clockwise direction in FIG. 2) relative to the external rotor 30, the front plate 40 and the rear plate 50. The torsion coil spring 62 compensates an average torque variation that is applied to the camshaft 10 while the internal combustion engine runs.

In the first embodiment, the bore 32 is coaxial to the receptive bore 33 while the vanes 60 are at the middle of the pressure chamber R0. The valve timing is set for optimal starting of the internal combustion engine when the bore 32 is coaxial to the receptive bore 33. In other words, the valve timing is slightly advanced when the bore 32 is coaxial to the receptive bore 33.

As shown in FIG. 4, when the bore 32 is coaxial to the receptive bore 33, the communication passage 26*a* is closed by the radial projection 31 so that no fluid communication is made between the first advance fluid passages 11 and the upper right advance chamber R10. As shown in FIG. 6, the communication passage 26*a* is opened to the advance chamber R10 when the vanes 60 rotate toward the most advanced position (clockwise direction in FIG. 6) so that the operational fluid is supplied/discharged between the first advance fluid passages 11 and the advance chamber R10. On the contrary, as shown in FIG. 7, the communication passage 26 is continuously closed by the radial projection when the vanes 60 rotates toward the most delayed position (counterclockwise direction in FIG. 7). Further, as shown in FIGS. 5, 6 and 7, the second advance fluid passage 13 always communicates with the upper right advance chamber R10 through the radial passage 29 from the most delayed position to the most advanced position.

In the first embodiment, as shown in FIG. 3, the sum of pressures in the advance chambers R1, R10 and a spring force from the torsion coil spring 62 balances with the sum of pressures in the delay chambers R2 and a rotational counter torque of the pressure chambers R0 when predetermined fluid pressures are supplied to the advance chambers R1, R10 and the delay chambers R2 after starting the internal combustion engine. When the external rotor 30 is rotated, the rotational counter force is always applied to the vanes 60 toward the most delayed position since the pressure chambers R0 and the vane 60 are in the torque transmission path between the external rotor 30 and the internal rotor 20. In accordance with various conditions of the internal combustion engine, the control valve 80 and the switching valve 90 are controlled to change the balance. The operational fluid is supplied to the advance chambers R1 and R10 through the first advance fluid passage 11, the communication passages 26 and 26*a,* and is discharged from the delay chambers R2 through the radial passages 23 and the delay fluid passage 12 when the duty ratio is increased to energize the control valve 80 and the switching valve 90 is energized. The internal rotor 20 and the vanes 60 rotate toward the most advanced position (clockwise direction in FIG. 3) relative to the external rotor 30, the front plate 40 and the rear plate 50 when the operational fluid is supplied to the advance chambers R1, R10 and is discharged from the delay chambers R2. Toward the most advanced position, the relative rotation of the internal rotor 20 and the vanes 60 is limited by the lower right vane 60 and the radial projection 31 as shown in FIG. 6. Further, the operational fluid is supplied to the delay chambers R2 through the delay fluid passage 12 and the radial passages 23, and is discharged from the advance chambers R1, R10 through the communication passages 26, 26*a,* 29 and the first and second advance fluid passages 11, 13 when the duty ratio is decreased to de-energize the control valve 80 and the switching valve 90. The internal rotor 20 and the vanes 60 rotate toward the most delayed position (counterclockwise direction in FIG. 3) relative to the external rotor 30, the front plate 40 and the rear plate 50 when the operational fluid is supplied to the delay chambers R2 and is discharged from the advance chambers R1, R10. Toward the most delayed position, the relative rotation of the internal rotor 20 and the vanes 60 is also limited by the lower right vane 60 and the radial projection 31 as shown in FIG. 7. A predetermined pressure is applied to either the receptive bore 33 or the ring space 35 of the bore 32 through the communication passages 23*a* or the communication passage 34. Due to the applied pressures to the lock pin 101, the lock pin 101 displaces toward the spring 102 so that the lock pin 101 disengages from the receptive bore 33. The switching valve 90 is always energized to keep communication between the advanced chamber R10 and the connection port 81*b* of the control valve 80. Accordingly, the vanes 60 may move quickly in the pressure chamber R0 since the advance chamber R10 is not sealed up. Further, the vanes 60 may be held at desired positions in the pressure chambers R0 by controlling the duty ratio for the control valve 80.

In the first embodiment, the bore 32 is coaxial to the receptive bore 33 while the vanes 60 are at the middle of the pressure chamber R0 as shown in FIG. 3. At this position, the valve timing is set for optimal starting of the internal combustion engine. Therefore, the valve timing may be further delayed up to the maximum delayed position as shown in FIG. 7. Thus, for the high-speed operation of the internal combustion engine, the control valve 80 and the switching valve 90 are controlled to further delay the valve timing. The volumetric efficiency can be improved by the inertia of the air intake under high-speed operation of the internal combustion engine so that higher output can be obtained.

When the internal combustion engine stalls, the oil pump P is no longer driven by the internal combustion engine so that the pressure chamber R0 does not receive any more pressurized operational fluid. At this time, the control valve 80 and the switching valve 90 are energized (or the duty ratios are increased for the control valve 80 and the switching valve 90) for a period of time. After the period of time is over, both the control valve 80 and the switching valve 90 are turned off. Further, when the internal combustion engine stalls, the solenoid 94*a* of the open/close valve 94 is also energized for this period. By supplying power to the valves 80, 90 and 94, the operational fluid is supplied from the accumulator 95 to the advance chamber R1 and R10 through the first advance fluid passages 11 and the communication passages 26, 26*a* (or the second advance fluid passage 13 and the communication passage 29). Therefore, the vanes 60 receive pressure in the advance chambers R1 and R10 and move toward the most advanced position. As a result, the internal rotor 20 and the camshaft 10 rotates toward the most advanced position against the rotational counter force so that the vanes 60 always reach to the most advanced position after the internal combustion engine stalls. The operational fluid is supplied to the ring space 35 in the bore 32 through the communication passage 34 when the internal combustion engine stalls. Therefore, the lock pin 101 is away from the receptive bore 33 so that the internal rotor 20 and camshaft 10 may rotate without any interference to the lock pin 101.

When the internal combustion engine starts, the oil pump P is driven by the engine, and the control valve 80 and the switching valve 90 are turned off. The operational fluid is discharged from the advance chambers R1, R10 to a drain through the communication passages 26, 26*a,* the first advance fluid passages 11, the switching valve 90 and the control valve 80. Upon cranking up the internal combustion engine, the timing sprocket 51 is driven by the timing chain (not shown). Due to the rotational counter torque, the camshaft 10 and the internal rotor 20 are rotated toward the most delayed position against the torsion coil spring 62. During cranking, the oil pump P cannot supply enough pressure to push the lock pin 101 into the bore 32 against the spring 102. Accordingly, the camshaft 10 and the internal rotor 20 are rotated toward the most delayed position relative to the external rotor 30. When the bore 32 becomes coaxial to the receptive bore 33, the communication passage 26*a* is closed by the radial projection 31 as shown in FIG. 4. Since the advance chamber R10 is sealed up, the rotation of the camshaft 10 and the internal rotor 20 slow down relative to the external rotor 30. Thus, the small diameter portion 191*a* of the lock pin 101 reliably projects to and engages with the receptive bore 33. In other words, the internal rotor 20 is mechanically locked with the external rotor 30 by the lock pin 101 when the bore 32 becomes coaxial to the receptive bore 33.

Therefore, despite the large torque variation, the camshaft 10 and the internal rotor 20 rotate integrally with the external rotor 30 as the internal combustion engine cranks up. The vanes cannot generate any undesirable noise since the vanes 60 are held at the middle of the pressure chamber R0 when the bore 32 becomes coaxial to the receptive bore 33.

According to the first embodiment of the present invention, undesirable noise shall not be generated at all while the internal combustion engine is cranking. Further, volumetric efficiency may be improved by delaying closure of an air-intake valve.

Figure 8:
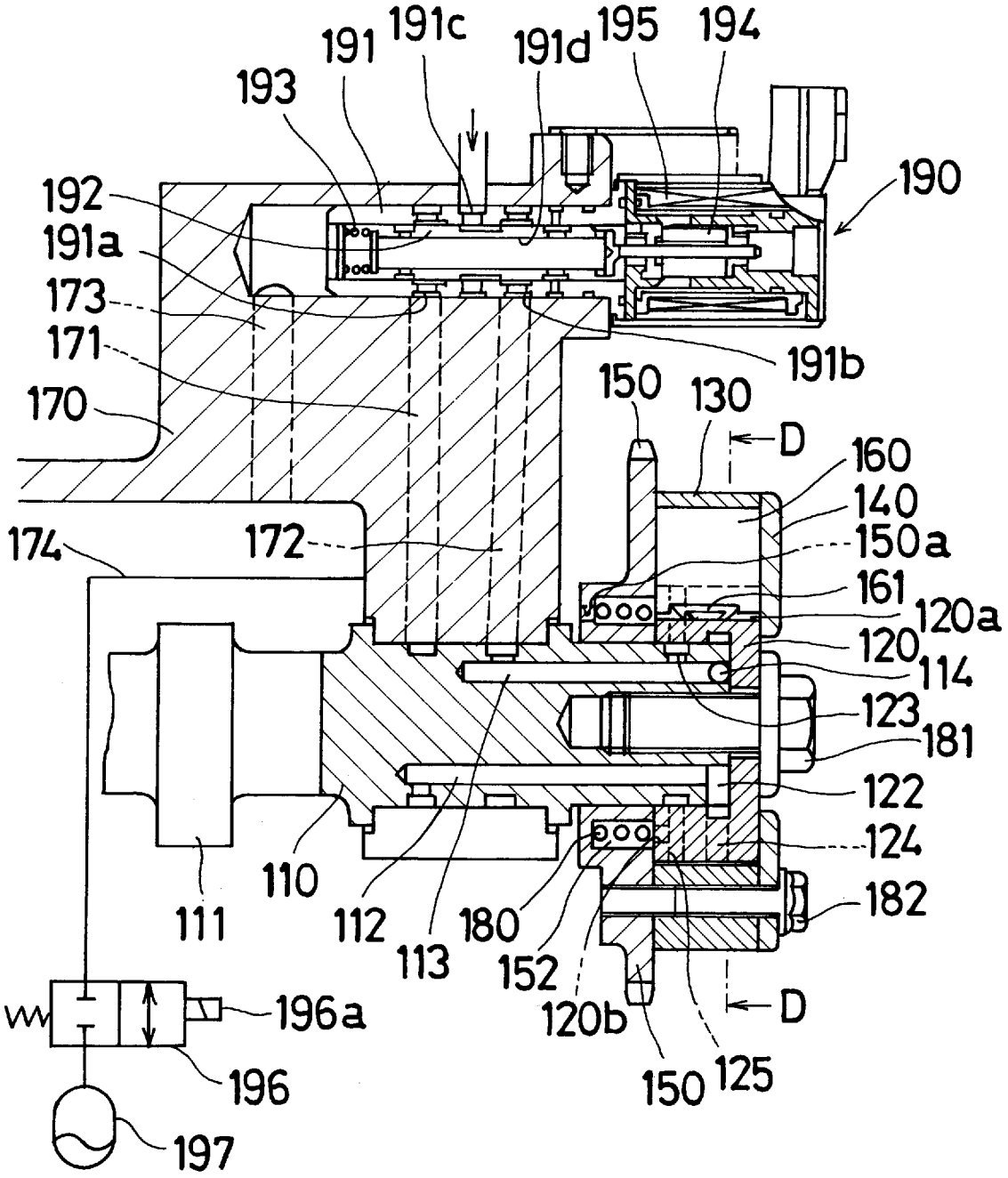
FIG. 8 is a cross sectional view of a variable valve timing controller according to the second embodiment of the present invention.
Figure 9:
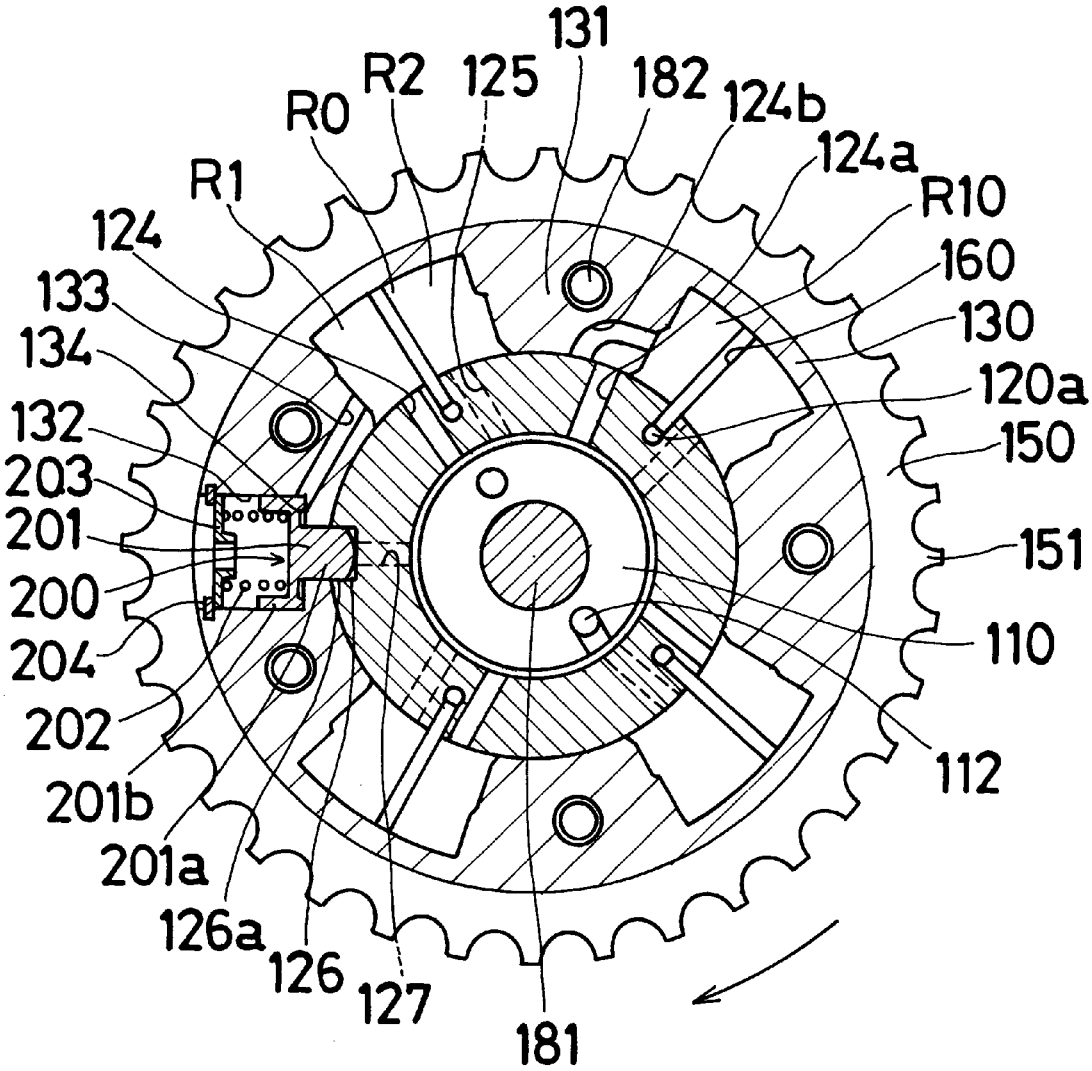
FIGS. 9 and 10 are cross sectional views of the variable timing controller taken along line D—D in FIG. 8.
Figure 10:
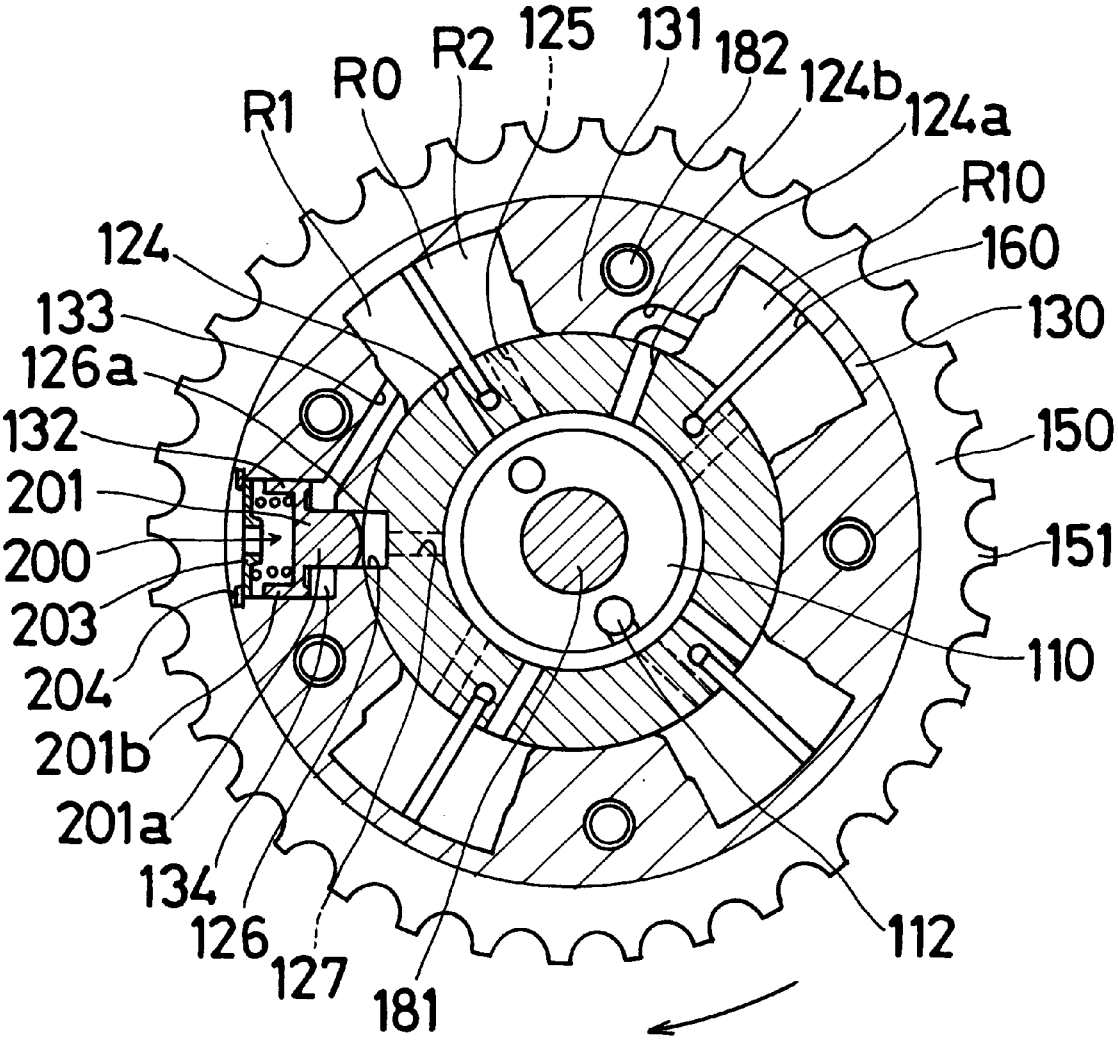

Referring now to FIGS. 8, 9 and 10, the second embodiment of the present invention is explained. As shown in FIG. 8, the variable timing valve controller comprises a camshaft 110, an internal rotor 120, an external rotor 130, a front plate 140, a rear plate 150, a timing sprocket 151, four vanes 160 and a lock mechanism 200. The camshaft 110 is rotatably supported by a cylinder head 170 of an internal combustion engine (not shown). The internal rotor 120 is integrally fixed to an end (a right end in FIG. 8) of the camshaft 170. The camshaft 110 and the internal rotor 120 constitute a rotational shaft to drive air-intake and exhaust valves of the internal combustion engine. The external rotor 130 is rotatably supported by both the camshaft 110 and the internal rotor 120. The external rotor 130 can rotate within a predetermined angle relative to the camshaft 110 and the internal rotor 120. The timing sprocket 151 is integrally formed on the outer circumference of the rear plate 150. The external rotor 130, the front plate 140, the rear plate 150 and the timing sprocket 151 constitute a rotation-transmitting member. The internal rotor 120 supports four vanes 160. The lock mechanism 200 is provided in the external rotor 120. The timing sprocket 151 is connected to a crankshaft (not shown) through a timing chain (not shown). The timing sprocket 151 is driven by the crankshaft so that the rotation-transmitting member is rotated clockwise in FIG. 9.

The camshaft 110 has cams (not shown) in order to drive the air-intake and exhaust valves. The interior of the camshaft 110 includes advance fluid passages 112 and a delay fluid passage 113. As shown in FIG. 9, the advance fluid passage 112 is formed in the camshaft 110. The advance fluid passages 112 are connected to a connection port 191*a* of the control valve 190 through a radial passage, a ring groove and a communication passage 171. For the advance fluid passage 112, the radial passage and the ring groove are formed on the camshaft 110. The communication passage 171 is formed in the cylinder head 170. The delay passage 113 is connected to a connection port 191*b* of the control valve 191 through a radial passage, a ring groove and a communication passage 172. For the delay passage 113, the radial passage and the ring groove are formed in the camshaft 110. The communication passage 172 is formed in the cylinder head 170. As shown in FIG. 8, a ball 114 is pressed into the delay fluid passage 113 in order to close an end of the delay fluid passage 113.

An oil pump (not shown) is driven by the internal combustion engine to supply the operational fluid to an inlet port 191*c* of the control valve 190. The control valve 190 includes a solenoid 195, a spool 192 and a spring 193. In FIG. 8, the solenoid 195 drives the spool 192 leftward against the spring 193 when the solenoid 195 is energized. In the energized state, the control valve 190 connects the inlet port 191*c* to a connection port 191*a* and also connects the connection port 191*b* to a drain port 191*d*. On the contrary, in the normal state, the control valve 190 connects the inlet port 191*c* to the connection port 191*b* and also connects the connection port 191*a* to the drain port 191*d*. The solenoid 195 of the control valve 190 is energized by an electronic controller (not shown). Because of duty ratio control of the electronic controller, the spool 192 may be linearly controlled to be retained at various intermediate positions. Accordingly, the operational fluid is supplied to the delay fluid passage 113 when the solenoid 192 of the control valve 190 is not energized. Further, the operational fluid is supplied to the advance fluid passage 112 when the solenoid 192 of the control valve 190 is energized.

In the second embodiment, an accumulator 197 is connected to the communication passage 171 through a communication passage 174. In the communication passage 174, an open/close valve 196 is interconnected. Power supply to a solenoid 196*a* is controlled by the electronic controller to conserve a predetermined pressure in the accumulator 197 while the internal combustion engine runs.

As shown in FIG. 8, the internal rotor 120 is cylindrical and is pressed into the end of the camshaft 110. The internal rotor 120 is fixed to the camshaft 110 by the screw 181 so that a bottom of the internal rotor 120 is contacted with the end of the camshaft 110. The internal rotor 120 has four slots 120*a* for supporting four vanes 160. The vanes 160 may slide in the slots 120*a* in the radial direction of the internal rotor 120. Further, as shown in FIG. 9, the internal rotor 120 has a receptive bore 126 that receives a small diameter portion 201*a* of a lock pin 201. The lock pin 201 engages with the receptive bore 126 when the external rotor 130 is at an intermediate position relative to the camshaft 110 and the internal rotor 120. A radial passage, a ring groove 123 and a communication passage 127 are provided in order to supply and discharge the operational fluid between the receptive bore 126 and the delay fluid passage 113. The radial passage and the ring groove 123 are provided in the camshaft 110. Four pressure chambers R0 are formed between the internal rotor 120 and the external rotor 130. Each of the vanes 160 divides the pressure chambers R0 into advance chambers R1, R10 and delay chambers R2. In order to supply and discharge the operational fluid to the delay chambers R2, four radial passages 125 are provided in the internal rotor 120 so as to supply and discharge the operational fluid between the delay fluid passage 113 and the delay chamber R2. Further, a radial passage 122, a ring groove and four communication passages 124, 124*a* are provided in order to supply and discharge the operational fluid to the advance chambers R1 and R10. The radial passage 122 and the ring groove are formed on the camshaft 110. The communication passages 124, 124*a* are formed in the internal rotor 120. The radial passages 124 and 125 are separately and independently provided in the axial direction of the camshaft 110 so that no communication is made between the radial passages 124 and 125.

The external rotor 130 is cylindrical. At both ends of the external rotor 130, a front plate 140 and a rear plate 150 are attached. Five screws 182 fasten the front plate 140, the external rotor 130 and the rear plate 150 to be integral. Further, four radial projections 131 are formed inwardly in the external rotor 130. The tops of the radial projections 131 are touched with the internal rotor 120 so that the external rotor 130 rotates around the internal rotor 120. The lock pin 201 and a spring 202 are contained in a bore 132 that is formed in one of the radial projections 131. The bore 32 extends in radial direction of the external rotor 130.

Each vane 160 has a rounded edge that touches with the external rotor 130 in a fluid tight manner. Both sides of each vane 60 also touch with both the plates 140 and 150 in a fluid tight manner. The vanes 160 may slide in the slots 120*a* in radial direction of the internal rotor 120. Each vane 60 divides each of the pressure chambers R0 into the advance chambers R1, R10 and the delay chamber R2. The pressure chambers R0 are formed by the external rotor 130, the radial projections 131, the internal rotor 120, the front plate 140 and the rear plate 150. In order to limit the relative rotation between the internal rotor 120 and the external rotor 130 within a predetermined range, the vanes 160 touch with the radial projections 130 at the most advanced and delayed positions.

The lock pin 201 comprises the small diameter portion 201*a* and a large diameter portion 201*b*. The lock pin 201 is slidably inserted in the bore 132. The lock pin 201 is pushed toward the internal rotor 120 by the spring 202. The spring 202 is inserted in the lock pin 201 and a retainer 203. The retainer 203 is held in the bore 132 by a snap ring 204. A ring dent is formed on a step between the small diameter portion 201*a* and the large diameter portion 201*b*. The ring dent forms a ring space 134 when the small diameter portion 201*a* is projected in the receptive bore 126 as shown in FIG. 9. The ring space 134 communicates with the adjacent advance chamber R1 through a communication passage 133 formed in the radial projection 131.

A ring groove 152 is formed in the rear plate 150. The ring groove 152 opens toward the internal rotor 120. In the ring groove 152, a torsion coil spring 180 is inserted. One end of the torsion coil spring 180 is hooked in a hole 150*a* drilled in a bottom of the ring groove 152. The other end of the torsion spring 180 is hooked in a hole 120*a* drilled in a base portion of the internal rotor 120. The torsion coil spring 180 biases the internal rotor 120, the vanes 160 and the camshaft 110 toward the most advanced direction (clockwise direction in FIG. 9) relative to the external rotor 130, the front plate 140 and the rear plate 150. The torsion coil spring 180 compensates an average torque variation that is applied to the camshaft 110 while the internal combustion engine runs.

In the second embodiment, similar to the first embodiment, the bore 132 is coaxial to the receptive bore 126 while the vanes 160 are at the middle of the pressure chamber R0. The valve timing is set for optimal starting of the internal combustion engine when the bore 132 is coaxial to the receptive bore 126. In other words, the valve timing is slightly advanced when the bore 126 is coaxial to the receptive bore 126.

As shown in FIG. 9, when the bore 132 is coaxial to the receptive bore 126, the communication passage 124*a* is closed by the radial projection 131 so that no fluid communication is made between the advance fluid passage 112 and the upper right advance chamber R10. The communication passage 124*a* is opened to the advance chamber R10 when the vanes 160 rotate toward the most advanced position (clockwise direction in FIG. 9) so that the operational fluid is supplied and discharged between the advance fluid passage 112 and the advance chamber R10. Further, a communication passage 124*b* is formed in the radial projection 131 adjacent to the delay side of the advance chamber R10. One end of the communication passage 124*b* is opened on the top of the radial projection 131. The other end of the communication passage 124*b* is opened to the advance chamber R10. The communication passage 124*b* communicates with one of the communication passages 124*a* when the internal rotor 120 rotates toward the most delayed position (counterclockwise in FIG. 9) with a predetermined tolerance angle "a". In order to smoothly engage the lock pin 210 with the receptive bore 126, the predetermined tolerance angle "a" corresponds to the width of chamfer that is formed by the aperture part of receptive bore 126.

In the second embodiment, as shown in FIG. 10, the sum of pressures in the advance chambers R1, R10 and a spring force from the torsion coil spring 180 balances with the sum of pressures in the delay chambers R2 and a rotational counter force of the pressure chambers R0 when predetermined fluid pressures are supplied to the advance chambers R1, R10 and the delay chambers R2 after start of the internal combustion engine. When the external rotor 30 is rotated, the rotational counter force is always applied to the vanes 160 toward the most delayed position since the pressure chambers R0 and the vane 160 are in the torque transmission path between the external rotor 130 and the internal rotor 120. In accordance with various conditions of the internal combustion engine, the control valve 190 is controlled to change the balance. The operational fluid is supplied to the advance chambers R1 and R10 through the advance fluid passage 112, the communication passages 124 and 124*a*, and is discharged from the delay chambers R2 through the radial passages 125 and the delay fluid passage 113 when the duty ratio is increased to energize the control valve 190. The internal rotor 120 and the vanes 160 rotate toward the most advanced position (clockwise direction in FIG. 10) relative to the external rotor 130, the front plate 140 and the rear plate 150 when the operational fluid is supplied to the advance chambers R1, R10 and is discharged from the delay chambers R2. Toward the most advanced position, the relative rotation of the internal rotor 120 and the vanes 160 is limited by contacts between the vanes 160 and the radial projections 131. Further, the operational fluid is supplied to the delay chambers R2 through the delay fluid passage 113 and the radial passages 125, and is discharged from the advance chambers R1, R10 through the communication passages 124, 124*a*, 124*b* and the advance fluid passages 112 when the duty ratio is decreased to de-energize the control valve 190. The internal rotor 120 and the vanes 160 rotate toward the most delayed position (counterclockwise direction in FIG. 10) relative to the external rotor 130, the front plate 140 and the rear plate 150 when the operational fluid is supplied to the delay chambers R2 and is discharged from the advance chambers R1, R10. Toward the most delayed position, the relative rotation of the internal rotor 120 and the vanes 160 is also limited by contacts between the vanes 160 and the radial projections 131. A predetermined pressure is applied to either the receptive bore 126 or the ring space 134 of the bore 132 thorough the communication passage 127 or the communication passage 133. Due to the applied pressures to the lock pin 201, the lock pin 201 displaces toward the spring 202 so that the lock pin 201 disengages from the receptive bore 126. Further, the vanes 160 may be held at desired positions in the pressure chambers R0 by control of the duty ratio for the control valve 190.

In the second embodiment, the bore 132 is coaxial to the receptive bore 126 while the vanes 160 are at the middle of the pressure chambers R0 as shown in FIG. 9. At this position, the valve timing is set for optimal starting of the internal combustion engine. Therefore, the valve timing may be further delayed up to the maximum delayed position. Thus, for high-speed operation of the internal combustion engine, the control valve 190 is controlled to further delay the valve timing. The volumetric efficiency can be improved by the inertia of the air intake under high-speed operation of the internal combustion engine so that higher output can be obtained.

When the internal combustion engine stalls, the oil pump (not shown) is no longer driven by the internal combustion engine so that the pressure chamber R0 does not receive the operational fluid anymore. At this time, the control valve 190 is energized (or the duty ratio is increased for the control valve 190) for a period of time. After this period is over, the control valve 190 is turned off. Further, when the internal combustion engine stalls, the solenoid 196*a* of the open/close valve 196 is also energized for the period. By supplying power to the valves 190 and 196, the operational fluid is supplied from the accumulator 197 to the advance chamber R1 and R10 through the advance fluid passages 112 and the communication passages 124, 124*a*. Therefore, the vanes 160 receive pressure in the advance chambers R1 and R10 toward the most advanced position. As a result, the internal rotor 120 and the camshaft 110 rotates toward the most advanced position against the rotational counter force so that the vanes 160 always reach the most advanced position after the internal combustion engine stalls. The operational fluid is supplied to the ring space 134 in the bore 32 through the communication passage 133 when the internal combustion engine is stalled. Therefore, the lock pin 201 is away from the receptive bore 126 so that the internal rotor 120 and camshaft 110 may rotate without any interference with the lock pin 201.

When the internal combustion engine is started, the oil pump (not shown) is driven by the engine and the control valve 190 is turned off. The operational fluid is discharged from the advance chambers R1, R10 to a drain through the communication passages 124, 124*a*, the advance fluid passage 112 and the control valve 190. Upon cranking up the internal combustion engine, the timing sprocket 151 is driven by the timing chain (not shown). Due to the rotational counter torque, the camshaft 110 and the internal rotor 120 are rotated toward the most delayed position against the torsion coil spring 180. During the cranking, the oil pump cannot supply enough pressure to push the lock pin 201 into the bore 132 against the spring 202. Accordingly, the camshaft 110 and the internal rotor 120 are rotated toward the most delayed position relative to the external rotor 130. When the bore 132 becomes coaxial to the receptive bore 126, the communication passage 124*a* is closed by the radial projection 131 as shown in FIG. 9. Since the advance chamber R10 is sealed up, the rotation of the camshaft 110 and the internal rotor 120 slow down relative to the external rotor 130. Thus, the small diameter portion 201*a* of the lock pin 201 reliably projects to and engages with the receptive bore 126. In other words, the internal rotor 120 is mechanically locked with the external rotor 130 by the lock pin 201 when the bore 132 becomes coaxial to the receptive bore 126. Further, in the second embodiment, although the bore 132 and the receptive bore 132 are not completely coaxial, the small diameter portion 201*a* can be projected to and engage with the receptive bore 126 within the predetermined tolerance angle "a" due to the width of chamfer that is formed by the aperture part of receptive bore 126.

According to the second embodiment of the present invention, no undesirable noise shall be generated while the internal combustion engine is cranking. Further, volumetric efficiency may be improved by delaying closure of an air-intake valve. Further, all the vanes 160 touch the radial projections in order to limit the rotation of the internal rotor 120 relative to the external rotor 130. However, the skilled artisan may use sole vane 160 to limit the rotation of the internal rotor 120 relative to the external rotor 130.

FIGS. 11 through 14 show the third embodiment of the present invention. As shown in FIGS. 11 through 14, a variable timing valve controller comprises a camshaft 310, an internal rotor 320, an external rotor 330, a front plate 340, a rear plate 350, a timing sprocket 351, four vanes 360 and a lock mechanism 390. The camshaft 310 is rotatably supported by a cylinder head 370 of an internal combustion engine (not shown). The internal rotor 320 is integrally fixed to an end (a right end in FIG. 11) of the camshaft 310. The camshaft 310 and the internal rotor 320 constitute a rotational shaft to drive air-intake and exhaust valves of the internal combustion engine. The external rotor 330 is rotatably supported by both the camshaft 310 and the internal rotor 320. The external rotor 330 can rotate within a predetermined angle relative to the camshaft 310 and the internal rotor 320. The timing sprocket 351 is integrally formed on the circumference of the rear plate 350. The external rotor 330, the front plate 340, the rear plate 350 and the timing sprocket 351 constitute a rotation-transmitting member. The internal rotor 320 supports four vanes 360. The lock mechanism 390 is provided in the external rotor 320. The timing sprocket 351 is linked to a crankshaft (not shown) through a timing chain (not shown). The timing sprocket 351 is driven by the crankshaft so that the rotation-transmitting member is rotated clockwise in FIGS. 12 through 14.

Figure 11:
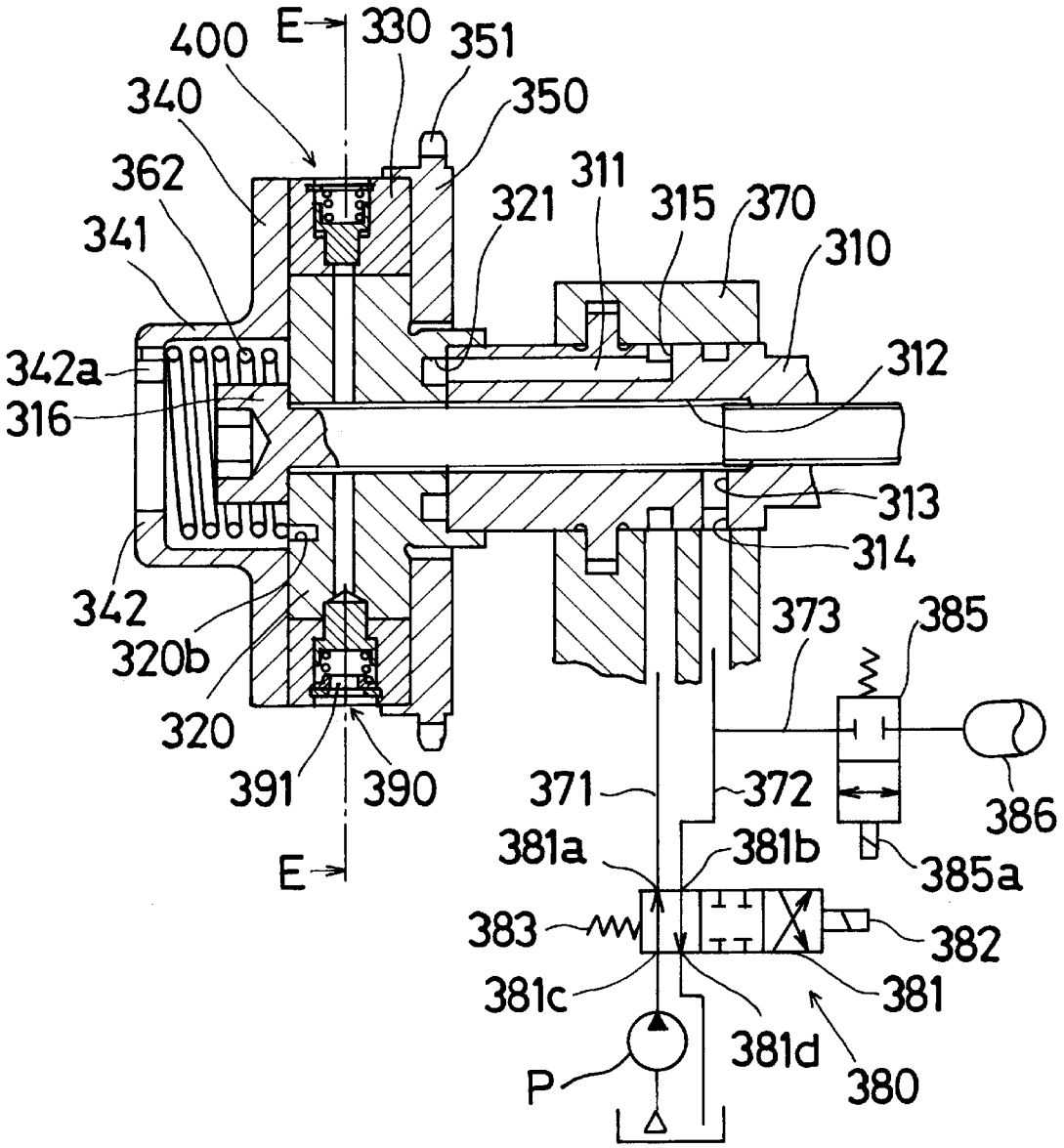
FIG. 11 is a cross-sectional view of a variable valve timing controller according to the third embodiment of the present invention.

The camshaft 310 has cams (not shown) in order to drive the air-intake and exhaust valves. The interior of the camshaft 310 includes an advance fluid passage 312 and a delay fluid passage 311. As shown in FIG. 11, both the advance fluid passages 312 and the delay fluid passage 311 extend axially in the camshaft 310. The advance fluid passages 312 are connected to a connection port 381*b* of the control valve 380 through a radial passage 313, a ring groove 314 and a communication passage 372. The radial passage 313 and the ring groove 314 are formed in the camshaft 310. The communication passage 372 is formed in the cylinder head 370. The delay passage 311 communicates with a connection port 381*a* of a control valve 380 through a ring groove 315 and a communication passage 371. The ring groove 315 is formed on the camshaft 310. The communication passage 371 is formed in the cylinder head 370.

The control valve 380 includes a solenoid 382, a spool 381 and a spring 383. In FIG. 11, the solenoid 382 drives the spool 381 leftward against the spring 383 when the solenoid 382 is energized. In the energized state, the control valve 380 connects the inlet port 381*c* to a connection port 381*b* and also connects the connection port 381*a* to a drain port 381*d*. On the contrary, in the normal state, the control valve 380 connects the inlet port 381*c* to the connection port 381*a* and also connects the connection port 381*b* to the drain port 381*d*. The solenoid 382 of the control valve 380 is energized by an electronic controller (not shown). Because of duty ratio control of the electronic controller, the spool 381 may be linearly controlled to be retained at various intermediate positions. All the ports 81*a*, 81*b*, 81*c* and 81*d* are closed while the spool 81 is retained at the intermediate position.

An accumulator 386 is connected to the communication passage 372 through a communication passage 373. In the communication passage 373, an open/close valve 385 is interconnected. Power supply to a solenoid 385*a* is controlled by the electronic controller to conserve a predetermined pressure in the accumulator 386 while the internal combustion engine runs.

The internal rotor 320 is cylindrical and is pressed into the end of the camshaft 310. The internal rotor 320 is fixed to the camshaft 310 by a screw 316 so that a bottom of the internal rotor 320 is contacted with the end of the camshaft 310. The internal rotor 320 has four slots 320*a* for supporting four vanes 360. The vanes 360 may slide in the slots 320*a* in the radial direction of the internal rotor 320. Further, the internal rotor 320 has a receptive bore 324 that receives a small diameter portion of a lock pin 391. The lock pin 391 engages with the receptive bore 324 when the external rotor 330 is at a certain position relative to the camshaft 310 and the internal rotor 320. A communication passage 325 is provided in order to supply and discharge the operational fluid between the advance fluid passage 312 and the receptive bore 324. Four pressure chambers R0 are formed between the internal rotor 320 and the external rotor 330. Each of the vanes 360 divides each of the pressure chambers R0 into advance chambers R1, R10 and delay chambers R2. Communication passages 323, 323*a* are provided in order to supply and discharge the operational fluid between the advance chambers R1 and the advance fluid passage 312. Further, four radial passages 326, a ring groove 321 and four axial passages 322 are provided in the internal rotor 320 in order to supply and discharge the operational fluid between the delay chambers R2 and the delay passage 311. The ring groove 321 is open to an end of the camshaft 310 to communicate with the delay passage 311. The receptive bore 324 extends in the radial direction at the circumference of the internal rotor 320. The vanes 360 are outwardly pushed by springs (not shown) that are inserted between the vanes 360 and slits 320*a*.

At both ends of the external rotor 330, a front plate 340 and a rear plate 350 are attached. The front plate 340, the external rotor 330 and the rear plate 350 are integrally fastened by four screws (not shown) that extend in four through holes 332. Further, four radial projections 331 are formed inwardly in the external rotor 330 with a predetermined pitch. Tops of the radial projections 331 are touched with the internal rotor 320 so that the external rotor 330 rotates around the internal rotor 320. The lock pin 391 and a spring 392 are contained in a bore 333 that is formed in one of the radial projections 331.

Figure 13:
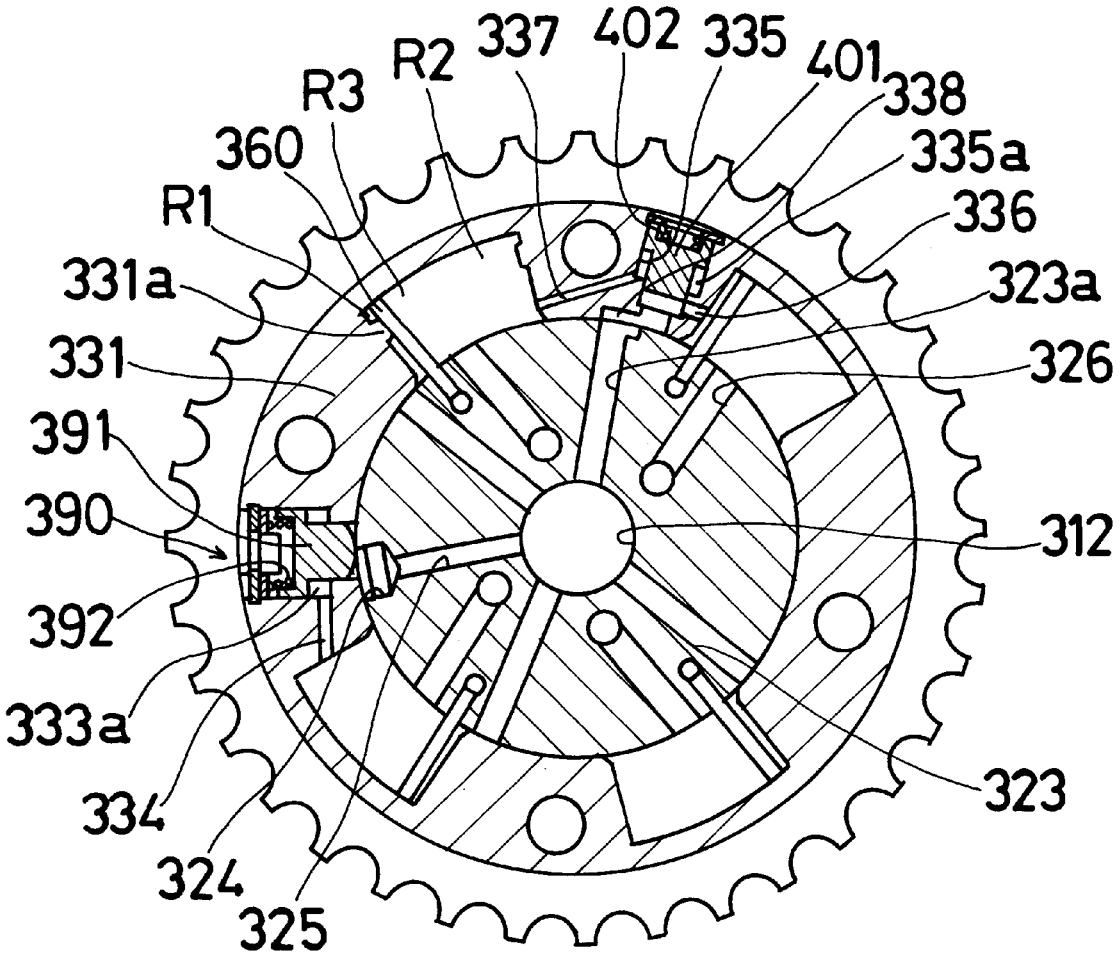
FIG. 13 is a cross sectional view of the variable valve timing controller showing the most delayed position.
Figure 14:
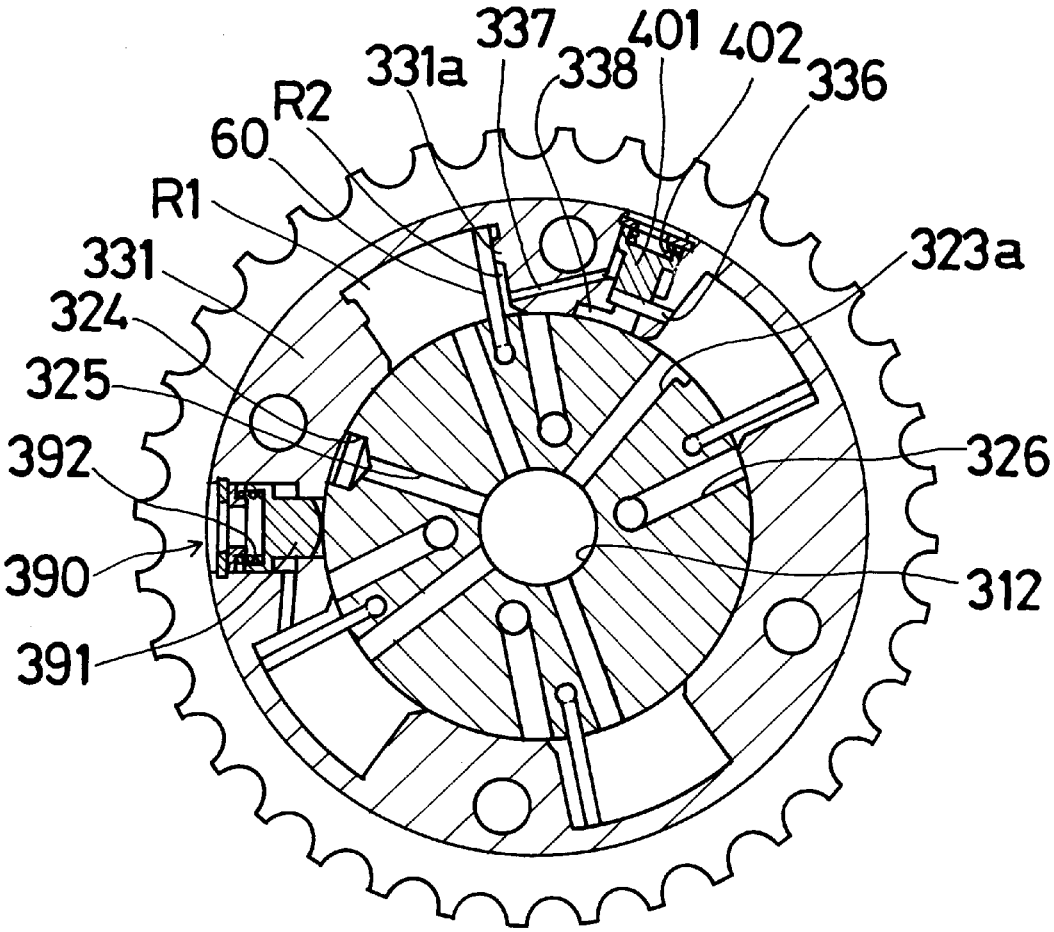
FIG. 14 is a cross sectional view of the variable valve timing controller showing the most advanced position.

Each vane 360 has a rounded edge that touches with the external rotor 330 in a fluid tight manner. Both sides of each vane 360 also touch with both the plates 340 and 360 in a fluid tight manner. The vanes 360 may slide in the slots 320*a* in the radial direction of the internal rotor 320. Each vane 360 divides each of the pressure chambers R0 into the advance chamber R1, R10 and the delay chamber R2. The pressure chambers R0 are formed by the external rotor 330, the radial projections 331, the internal rotor 320, the front plate 340 and the rear plate 350. As shown in FIGS. 13 and 14, in order to limit the relative rotation between the internal rotor 320 and the external rotor 330 within a predetermined range, one of the vanes 360 (the upper left) touches with a pair of circumference projections 331 a at the most advanced and delayed positions. In other words, as shown in FIG. 14, the most advanced position is achieved when the upper left vane 360 touches an advance side of the circumference projection 331*a* due to the expanded advance chambers R1. Further, as shown in FIG. 13, the most delayed position is achieved when the upper left vane 360 touches a delay side of the circumference projection 331*a* due to the expanded delay chambers R2.

Figure 12:
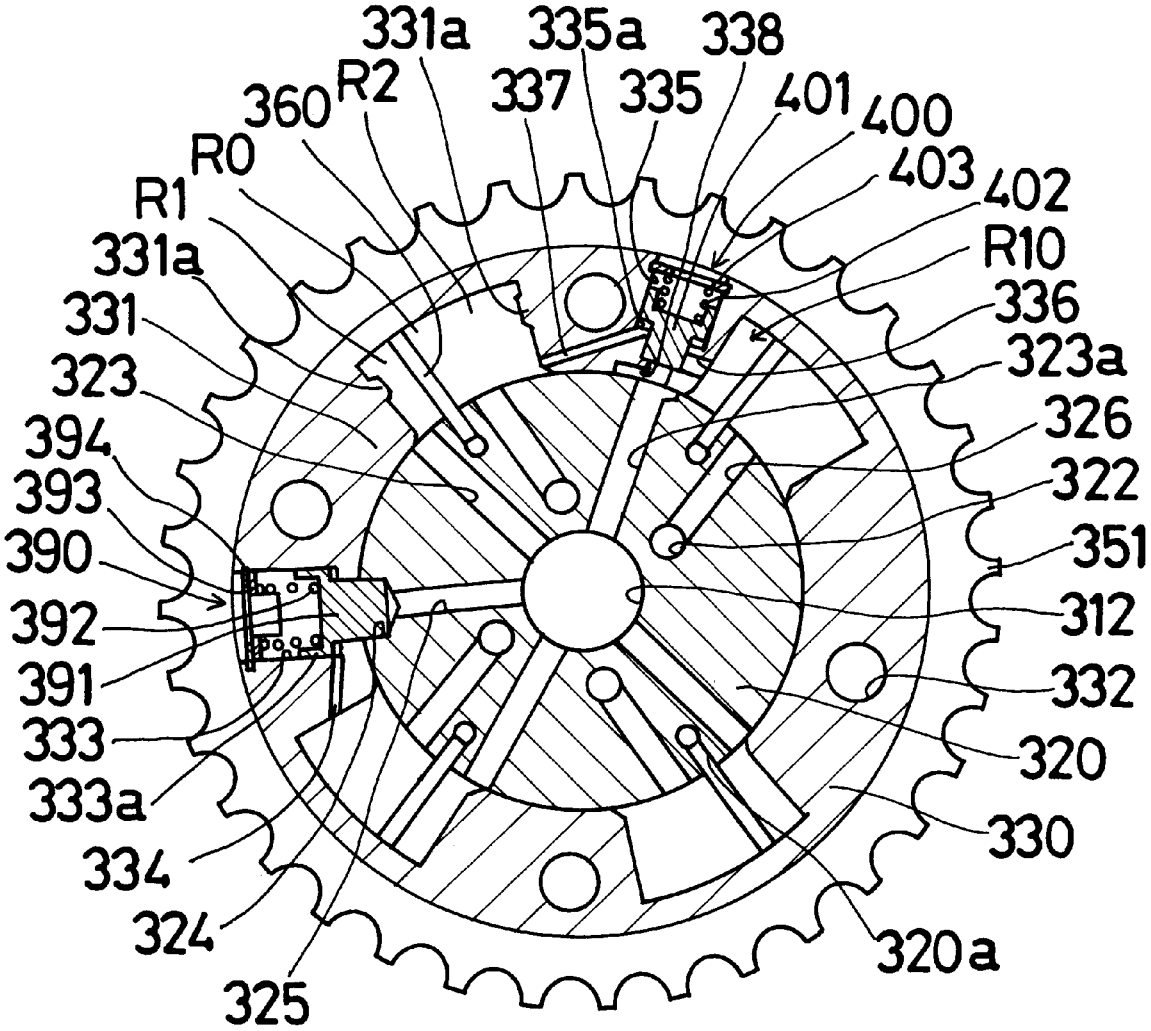
FIG. 12 is a cross sectional view of a variable valve timing controller taken along line E—E in FIG. 11.

The lock pin 391 is slidably inserted in the bore 333. The lock pin 391 is pushed toward the internal rotor 320 by the spring 392. The spring 392 is inserted in the lock pin 391 and a retainer 393. The retainer 393 is held in the bore 333 by a snap ring 394. A ring dent is formed on a step between the small diameter portion and the large diameter portion of the lock pin 391. The ring dent forms a ring space 333*a* when the small diameter portion of the lock pin 391 is projected in the receptive bore 324 as shown in FIG. 12. The ring space 333*a* communicates with the adjacent delay chamber R2 through a communication passage 334 formed in the radial projection 331.

A cavity 341 is formed on the front plate 340 in order to accommodate a screw 341. In the cavity 341, a torsion coil spring 362 is inserted. One end of the torsion coil spring 362 is hooked in a hole 320*b* drilled in a base of the internal rotor 320. The other end of the torsion spring 362 is hooked in a hole 342*a* drilled in a bottom portion of the cavity 341. The torsion coil spring 362 biases the internal rotor 320, the vanes 360 and the camshaft 310 toward the most advanced position (clockwise direction in FIGS. 12, 13 and 14) relative to the external rotor 330, the front plate 340 and the rear plate 350. The torsion coil spring 362 compensates an average torque variation that is applied to the camshaft 310 while the internal combustion engine runs.

In the third embodiment, similar to the first and the second embodiments, the bore 333 is coaxial to the receptive bore 324 while the vanes 360 are at the middle of the pressure chamber R0. The valve timing is set for optimal starting of the internal combustion engine when the bore 333 is coaxial to the receptive bore 324.

As shown in FIG. 12, when the bore 333 is coaxial to the receptive bore 324, the communication passage 323*a* is closed by the radial projection 331 so that no fluid communication is made between the advance fluid passage 312 and the upper right advance chamber R10. The communication passage 323*a* is opened to the advance chamber R10 when the vanes 60 rotate toward the most advanced position (clockwise direction in FIG. 12) so that the operational fluid is supplied and discharged between the advance fluid passage 312 and the advance chamber R10.

Further, a damping mechanism 400 is provided in the radial projection 331 that locates the delay side of the upper right advance chamber R10. The damping mechanism 400 includes a cut off pin 401 provided in a stepped bore 335. The stepped bore 335 extends in the radial direction of the external rotor 330. A notch 338 is formed at the top of the radial projection 331. The notch 335 extends from a small diameter portion of the stepped bore 335. The notch 338 communicates with the communication passage 323*a* when the bore 333 is coaxial to the receptive bore 324, and when the internal rotor 320 rotates from there toward the most delayed position (counterclockwise in FIG. 12) relative to the external rotor 330. Further, a communication passage 336 is provided in the radial projection 331. The communication passage 336 connects between the advance chamber R10 and the side of the small diameter portion of the stepped bore 335. Therefore, the notch 338 can selectively communicate with the advance chamber R10 through the small diameter portion of the stepped bore 335 and the communication passage 336.

The cut off pin 401 is inserted in the stepped bore 335. The cut off pin 401 slides in the stepped bore in the axial direction of the stepped bore 335. A spring 402 is provided between the cut off pin 401 and a snap ring 403 to push the cut off pin 401 toward the internal rotor 320. As shown in FIG. 12, the cut off pin 401 can cut the communication between the notch 338 and the advance chamber R10 when the cut off pin 401 projects toward the internal rotor 320. Under this cut off condition, a ring space 335*a* is formed between the stepped portion of the stepped bore 335 and the cut off pin 401. The ring space 335*a* is connected to the adjacent delay chamber R2 through a communication passage 337.

In the third embodiment, the bore 333 is coaxial to the receptive bore 324 while the vanes 60 are at the middle of the pressure chamber R0 as shown in FIG. 12. At this position, the valve timing is set for optimal starting of the internal combustion engine. Therefore, at this position, the valve timing is slightly advanced for easier engine starting.

The sum of pressures in the advance chambers R1, R10 and a spring force from the torsion coil spring 362 balances with sum of pressures in the delay chambers R2 and a rotational counter force of the pressure chambers R0 when predetermined fluid pressures are supplied to the advance chambers R1, R10 and the delay chambers R2 after the start of the internal combustion engine. In accordance with various conditions of the internal combustion engine, the control valve 380 is controlled to change the balance. The operational fluid is supplied to the advance chambers R1 and R10 through the advance fluid passage 312, the communication passages 323 and 323*a,* and is discharged from the delay chambers R2 through the communication passages 326, 322 and the delay fluid passage 311 when the duty ratio is increased to energize the control valve 380. The internal rotor 320 and the vanes 360 rotate toward the most advanced position (clockwise direction in FIG. 12) relative to the external rotor 330, the front plate 340 and the rear plate 350 when the operational fluid is supplied to the advance chambers R1, R10, and is discharged from the delay chambers R2. Toward the most advanced position, the relative rotation of the internal rotor 320 and the vanes 360 is limited by the upper left vane 60 and the circumference projection 331*a* as shown in FIG. 14. Further, the operational fluid is supplied to the delay chambers R2 through the delay fluid passage 311 and the communication passages 322, 326, and is discharged from the advance chambers R1, R10 through the communication passages 323, 323*a,* 29 and the advance fluid passage 312 when the duty ratio is decreased to de-energize the control valve 380. The internal rotor 320 and the vanes 360 rotate toward the most delayed position (counterclockwise direction in FIG. 12) relative to the external rotor 330, the front plate 340 and the rear plate 350 when the operational fluid is supplied to the delay chambers R2 and is discharged from the advance chambers R1, R10. Toward the most delayed position, the relative rotation of the internal rotor 320 and the vanes 360 is also limited by the lower right vane 360 and the circumference projection 331*a* as shown in FIG. 13. A predetermined pressure is applied to either the receptive bore 324 or the ring space 333*a* of the bore 333 through the communication passage 325 or the communication passage 334. Due to the applied pressures to the lock pin 391, the lock pin 391 displaces toward the spring 392 so that the lock pin 391 disengages from the receptive bore 324. Further, the vanes 360 may be held at desired positions in the pressure chambers R0 by control of the duty ratio for the control valve 380. Further, a predetermined pressure is applied to either the small diameter portion of the stepped bore 335 or the ring space 335*a* of the bore 335 through the communication passages 323*a,* 338 or the communication passage 337. Due to the applied pressures to the cut off pin 401, the cut off pin 401 displaces toward the spring 402 and is inserted in the stepped bore 335 so that the communication passage 338 connects with the communication passage 336.

In the third embodiment, the bore 333 is coaxial to the receptive bore 324 while the vanes 360 are at the middle of the pressure chamber R0 as shown in FIG. 12. At this position, the valve timing is set for optimal starting of the internal combustion engine. Therefore, the valve timing may be further delayed up to the maximum delayed position as shown in FIG. 13. Thus, for the highspeed operation of the internal combustion engine, the control valve 380 is controlled to further delay the valve timing. The volumetric efficiency can be improved by the inertia of the air intake under high-speed operation of the internal combustion engine so that higher output can be obtained.

When the internal combustion engine stalls, the oil pump P is no longer driven by the internal combustion engine so that the pressure chamber R0 does not receive any more pressurized operational fluid. At this time, the control valve 380 is energized (or the duty ratios are increased for the control valve 380) for a period of time. After this period is over, the control valve 380 is turned off. Further, when the internal combustion engine is stalled, the solenoid 385*a* of the open/close valve 385 is also energized for the period. By supplying power to the valves 380 and 385, the operational fluid is supplied from the accumulator 386 to the advance chamber R1 and R10 through the first advance fluid passage 312 and the communication passages 323, 323*a*. Therefore, the vanes 360 receive pressures in the advance chambers R1 and R10 toward the most advanced position. At this time, even the relative position between the internal rotor 320 and the external rotor 330 is somewhere between the positions shown in FIGS. 12 and 13, the operational fluid is supplied from the accumulator 386 to the stepped bore 335 through the communication passages 323*a* and 338. Due to the operational fluid supplied to the stepped bore 335, the cut off pin 401 displaces outwardly to connect the notch 338 and the communication passage 336. As a result, the internal rotor 320 and the camshaft 310 rotates toward the most advanced position against the rotational counter torque so that the vanes 360 always reach the most advanced position after the internal combustion engine stalls. The operational fluid is supplied to the receptive bore 324 through the communication passage 325 when the internal combustion engine stalls. Therefore, the lock pin 391 is away from the receptive bore 324 so that the internal rotor 320 and camshaft 310 may rotate without any interference to the lock pin 391.

When the internal combustion engine is started, the oil pump P is driven by the engine and the control valve 380 is turned off. The operational fluid is discharged from the advance chambers R1, R10 to a drain through the communication passages 323, 323*a,* the advance fluid passage 312 and the control valve 380. Upon cranking up the internal combustion engine, the timing sprocket 351 is driven by the timing chain (not shown). Due to the rotational counter torque, the camshaft 310 and the internal rotor 320 are rotated toward the most delayed position against the torsion coil spring 362. During the cranking, the oil pump P cannot supply enough pressure to push the lock pin 391 into the bore 333 against the spring 392. Further, during the cranking, the oil pump P cannot supply enough pressure to push the cut off pin 401 into the stepped bore 335 against the spring 402 so that the cut off pin 401 stops communication between the notch 338 and the communication passage 336. Accordingly, the camshaft 310 and the internal rotor 320 are rotated toward the most delayed position relative to the external rotor 333. When the bore 333 becomes coaxial to the receptive bore 324, the communication passage 323*a* is closed by the radial projection 331 as shown in FIG. 12. Since the advance chamber R10 is sealed up, the camshaft 310 and the internal rotor 320 slowly rotate relative to the external rotor 330. Thus, the small diameter portion of the lock pin 391 reliably projects to and engages with the receptive bore 324. In other words, the internal rotor 320 is mechanically locked with the external rotor 330 by the lock pin 391 when the bore 333 becomes coaxial to the receptive bore 324.

According to the third embodiment of the present invention, no undesirable noise shall be generated while the internal combustion engine is cranking. Further, volumetric efficiency may be improved by delaying closure of an air-intake valve.

In the third embodiment, the cut off pin 401 is displaced by the operational fluid supplied from the notch 338 and the communication passage 323*a*. However, it is obvious for the skilled artisan to modify the cut off pin 401 to be displaced by centrifugal force. To do so, the weight of the cut off pin 401 and/or the spring force of the spring 402 is designed to displace the cut off pin 401 outwardly against the spring 402 over a threshold rotational speed Vth of the external rotor 330. The threshold rotational speed Vth has to be greater than cranking speed Vc of the external rotor 330 under cranking operation of the internal combustion engine. Further, the threshold rotational speed Vth has to be smaller than idling speed Vi of the external rotor 330 while the internal combustion engine idles. In short, the threshold rotational speed Vth is set in the range of Vc<Vth<Vi. By this modification, similar to the third embodiment, the cut off valve 401 cuts the communication between the notch 338 and the communication passage 336 during the cranking operation of the internal combustion engine. Therefore, since the advance chamber R10 is sealed up, the camshaft 310 and the internal rotor 320 slowly rotate relative to the external rotor 330.

In the above embodiments, the vanes are separated from the internal rotors. Further, the lock pins are displaced in the radial direction of the internal rotors. However, the present invention may adapt to the other type of the variable valve timing controller. For example, the vanes may be thickened in a circumferential direction to be integrated with the internal rotor. The bore may be formed in the rear plate and the receptive bore may be formed in the front plate or vice versa so that the lock pin may be displaced in the axial direction of the internal rotor. Further, in the above embodiments, at least one vane limits the most advanced and the delayed positions by touching the adjacent radial projections. However, this invention may adapt to the other type of the variable valve timing controller. For example, pressures may be controlled in the advance and delay chambers so that the vanes do not touch the radial projections. Furthermore, in the above embodiments, the camshaft drives the air intake valves of the internal combustion engine. However, this invention may adapt to the other camshaft that drives the exhaust valves of the internal combustion engine.

According to the present invention, the locking mechanism maintains the vane in the middle of the pressure chamber until the internal combustion engine starts. Therefore, the vane cannot vibrate even when unstable transitional pressure is supplied to the pressure chamber so that no undesirable noise shall be generated.

Further, the valve timing may be further delayed after the internal combustion engine starts since the vane is maintained in the middle of the pressure chamber. Therefore, the valve timing may be consistently optimized not only for the easy engine start but also for the high-speed operation of the internal combustion engine. Thus, the volumetric efficiency can be improved by the inertia of the air intake under the high-speed operation of the internal combustion engine.

While the invention has been described in conjunction with some of its preferred embodiments, it should be understood that changes and modifications may be made without departing from the scope and spirit of the appended claims.

What is claimed is:

1. A variable valve timing controller using an operational fluid for valves of an internal combustion engine comprising:

a rotational shaft for opening and closing the valve;

a rotation-transmitting member rotatably mounted on the rotational shaft;

a pressure chamber formed between the rotational shaft and the rotation-transmitting member;

an advance chamber formed in the pressure chamber to advance the valve timing by expansion thereof;

a delay chamber formed in the pressure chamber to delay the valve timing by expansion thereof;

a vane supported by either one of the rotational shaft or the rotation transmitting member and for dividing the pressure chamber into the advance chamber and the delay chamber;

an advance fluid passage communicating with the advance chamber for supplying and discharging the operational fluid;

a delay fluid passage communicating with the delay chamber for supplying and discharging the operational fluid;

a locking mechanism for holding the vane in the middle of the pressure chamber until the internal combustion engine starts; and a damper for sealing up one of the advance chamber and the delay chamber and for slowing the relative rotation between the rotational shaft and the rotation-transmitting member.

2. A variable valve timing controller according to claim 1 further comprising:

a pressure source;

a drain for supplying the operational fluid to the pressure source;

a control valve for selectively connecting the pressure source to one of the advance fluid passage and the delay fluid passage and for connecting the drain to the other fluid passage;

an electronic controller for the control valve to connect the pressure source to the advance fluid passage for a period of time after the internal combustion engine stalls.

3. A variable valve timing controller according to claim 1 wherein the locking mechanism holds the vane in the middle of the pressure chamber when pressures are decreased in the advance fluid passage and the delay fluid passage.

4. A variable valve timing controller according to claim 2 further comprising:

a spring member for urging the rotational shaft and for advancing the valve timing.

5. A variable valve timing controller according to claim 2 wherein:

the advance fluid passage further comprising a first advance fluid passage selectively closed by the relative rotation between the rotational shaft and the rotation-transmitting member and a second advance fluid passage always communicating with the advance chamber; and the damper further comprising a valve for closing the first advance fluid passage while the internal combustion engine is stalled.

6. A variable valve timing controller according to claim 2 wherein the advance fluid passage is closed when the locking mechanism holds the vane in the middle of the pressure chamber.

7. A variable valve timing controller according to claim 2 wherein the damper further comprises a cut off valve to be closed when pressures are decreased in the advance fluid passage and the delay fluid passage.

8. A variable valve timing controller according to claim 2 wherein the locking mechanism holds the vane in the middle of the pressure chamber when pressures are decreased in the advance fluid passage and the delay fluid passage.

9. A variable valve timing controller according to claim 4 wherein:

the advance fluid passage further comprising a first advance fluid passage selectively closed by the relative rotation between the rotational shaft and the rotation-transmitting member and a second advance fluid passage always communicating with the advance chamber; and the damper further comprising a valve for closing the first advance fluid passage while the internal combustion engine is stalled.

10. A variable valve timing controller according to claim 4 wherein the advance fluid passage is closed when the locking mechanism is able to hold the vane in the middle of the pressure chamber.

11. A variable valve timing controller according to claim 4 wherein the damper further comprises a cut off valve to be closed when pressures are decreased in the advance fluid passage and the delay fluid passage.

12. A variable valve timing controller according to claim 9 wherein the pressure source comprises an accumulator for conserving a pressure while the internal combustion engine runs.

13. A variable valve timing controller according to claim 9 wherein the locking mechanism holds the vane in the middle of the pressure chamber when pressures are decreased in the advance fluid passage and the delay fluid passage.

14. A variable valve timing controller according to claim 10 wherein the pressure source comprises an accumulator for conserving a pressure while the internal combustion engine runs.

15. A variable valve timing controller according to claim 10 wherein the locking mechanism holds the vane in the middle of the pressure chamber when pressures are decreased in the advance fluid passage and the delay fluid passage.

16. A variable valve timing controller according to claim 11 wherein the pressure source comprises an accumulator for conserving a pressure while the internal combustion engine runs.

17. A variable valve timing controller according to claim 11 wherein the locking mechanism holds the vane in the middle of the pressure chamber when pressures are decreased in the advance fluid passage and the delay fluid passage.

18. A variable valve timing controller according to claim 12 wherein the locking mechanism holds the vane in the middle of the pressure chamber when pressures are decreased in the advance fluid passage and the delay fluid passage.

19. A variable valve timing controller according to claim 14 wherein the locking mechanism holds the vane in the middle of the pressure chamber when pressures are decreased in the advance fluid passage and the delay fluid passage.

20. A variable valve timing controller according to claim 16 wherein the locking mechanism holds the vane in the middle of the pressure chamber when pressures are decreased in the advance fluid passage and the delay fluid passage.

* * * * *

UNITED STATES PATENT AND TRADEMARK OFFICE

CERTIFICATE OF CORRECTION

PATENT NO. : 6,035,819
APPLICATION NO. : 09/239722
DATED : March 14, 2000
INVENTOR(S) : Nakayoshi et al.

It is certified that error appears in the above-identified patent and that said Letters Patent is hereby corrected as shown below:

Title Page,
Item [30], please insert --Foreign Application Priority Data
January 30, 1998 [JAPAN] 10-19056
March 27, 1998 [JAPAN] 10-116997--

Signed and Sealed this

Twelfth Day of February, 2008

JON W. DUDAS
*Director of the United States Patent and Trademark Office*